US009932199B2

(12) United States Patent
Katsumata et al.

(10) Patent No.: US 9,932,199 B2
(45) Date of Patent: Apr. 3, 2018

(54) SHEET PROCESSING DEVICE AND IMAGE FORMATION APPARATUS PROVIDED WITH THE SAME

(71) Applicants: Toshiyuki Katsumata, Yamanashi-ken (JP); Hisashi Osada, Yamanashi-ken (JP); Takeshi Fukasawa, Kofu (JP)

(72) Inventors: Toshiyuki Katsumata, Yamanashi-ken (JP); Hisashi Osada, Yamanashi-ken (JP); Takeshi Fukasawa, Kofu (JP)

(73) Assignee: CANON FINETECH NISCA INC., Misato-shi, Saitama (JP)

( * ) Notice: Subject to any disclaimer, the term of this patent is extended or adjusted under 35 U.S.C. 154(b) by 156 days.

(21) Appl. No.: 15/060,006

(22) Filed: Mar. 3, 2016

(65) Prior Publication Data

US 2016/0264374 A1 Sep. 15, 2016

(30) Foreign Application Priority Data

Mar. 9, 2015 (JP) ..... 2015-045713
Mar. 9, 2015 (JP) ..... 2015-045714
Mar. 9, 2015 (JP) ..... 2015-045715

(51) Int. Cl.

*B65H 45/04* (2006.01)
*B65H 45/18* (2006.01)
*B65H 31/02* (2006.01)
*B31F 1/00* (2006.01)

(52) U.S. Cl.

CPC ..... *B65H 45/18* (2013.01); *B65H 31/02* (2013.01); *B65H 45/04* (2013.01); *B31F 1/0035* (2013.01); *B65H 2301/4213* (2013.01); *B65H 2301/42146* (2013.01); *B65H 2301/4505* (2013.01); *B65H 2301/51232* (2013.01); *B65H 2404/1422* (2013.01); *B65H 2701/13212* (2013.01); *B65H 2801/27* (2013.01)

(58) Field of Classification Search

CPC ..... B31F 1/0035; B65H 45/04; B65H 2301/51232; B65H 2701/13212
USPC ..... 270/32, 45, 58.07
See application file for complete search history.

(56) References Cited

U.S. PATENT DOCUMENTS 7,431,274 B2 10/2008 Kushida et al.
7,673,862 B2 3/2010 Kushida et al.
(Continued)

FOREIGN PATENT DOCUMENTS

JP 2005-212991 A * 8/2005
JP 4217640 B2 2/2009
(Continued)

*Primary Examiner* — Leslie A Nicholson, III
(74) *Attorney, Agent, or Firm* — Manabu Kanesaka

(57) ABSTRACT

A sheet processing device includes a plurality of first units and a second unit. The first units each include, as one unit, a pressing member that presses a folding loop, a frame that movably holds the pressing member in a sheet pressing direction, and an elastic member that is disposed between the frame and the pressing member to bias the pressing member in the sheet pressing direction. The second unit supports, as one unit, a plurality of rows of first units such that the first units of each row are arranged, as a pair, so as to be opposed to each other and that an interval between the pairs is reduced stepwise from a downstream side to an upstream side in a moving direction of the second unit.

20 Claims, 15 Drawing Sheets

(56) References Cited

U.S. PATENT DOCUMENTS

| | | | | |
|---|---|---|---|---|
| 8,201,815 | B2 * | 6/2012 | Sasahara | B65H 45/18 270/32 |
| 8,459,630 | B2 * | 6/2013 | Watanabe | B65H 45/18 270/32 |
| 8,459,631 | B2 * | 6/2013 | Ishikawa | B42B 4/00 270/32 |
| 8,596,631 | B2 * | 12/2013 | Ishikawa | B42B 4/00 270/32 |
| 8,613,435 | B2 * | 12/2013 | Kato | B65H 45/18 270/32 |
| 9,221,648 | B2 * | 12/2015 | Sugiyama | B31F 1/00 |
| 2014/0077436 | A1 | 3/2014 | Hata et al. | |
| 2015/0375957 | A1 | 12/2015 | Fukusawa et al. | |
| 2015/0375958 | A1 | 12/2015 | Fukusawa et al. | |

FOREIGN PATENT DOCUMENTS

| | | | |
|---|---|---|---|
| JP | 4514217 | B2 | 7/2010 |
| JP | 2012-201462 | A | 10/2012 |
| JP | 2014-76903 | A | 5/2014 |

* cited by examiner

SHEET PROCESSING DEVICE AND IMAGE FORMATION APPARATUS PROVIDED WITH THE SAME

RELATED APPLICATIONS

The present application is based on, and claims priority from, Japanese Applications No. JP2015-045713 filed Mar. 9, 2015; No. 2015-045714 filed Mar. 9, 2015; and No. 2015-045715 filed Mar. 9, 2015, the disclosure of which is hereby incorporated by reference herein in its entirety.

BACKGROUND OF THE INVENTION

Field of the Invention

The present invention relates to a sheet processing device that folds a sheet bundle formed by sheets that are sequentially carried out from an image forming device such as a copier or a printer and accumulated in a bundle and, more particularly, to a sheet processing device that presses a folding loop of the folded sheet bundle so as to prevent sheet bundle from being opened after discharge therefrom.

Description of the Related Art

There are widely known processing devices that align sheets carried out from an image forming device and staple them, or fold them into a booklet. Among them, some processing devices are configured to saddle-stitch the sheet bundle with a staple or an adhesive and fold the sheet bundle into a booklet. Such a device performs folding for sheet bundle formed by about few sheets up to about 30 sheets in two; however, there may be a case where the two-folded sheet bundle is unintentionally opened after being discharged from the device, resulting in reduction in accumulation amount.

Thus, it is widely known that, after the folding, the folding loop of the two-folded sheet bundle is subjected to pressing from thereabove and therebelow.

For example, Japanese Patent No. 4,217,640 (see corresponding U.S. Pat. No. 7,431,274 and U.S. Pat. No. 7,673,862) discloses a device that is moved along a folding loop of a two-folded sheet bundle while pinching/pressing the folding loop by means of pressing rollers disposed above and below the folding loop. This device is also provided with a flattening roller that presses the folding loop from a front side thereof at a position slightly rearward of the pinching/pressing position of the upper and lower pressing rollers. That is, in this device, the pressing rollers that pinch/press the folding loop from thereabove and therebelow and flattening roller that presses the folding loop from the front side thereof are formed into one unit, and this unit is moved along the sheet folding loop. Thus, a portion that is pinched by the pressing rollers can be made flat, thereby reducing wrinkles and breaks of the folding loop due to a difference in gripping force.

Further, as illustrated in detail in FIGS. 11 and 12, Japanese Patent No. 4217640 discloses, as a device of a second embodiment, a device in which a unit provided with a pair of pressing rollers that pinch/press the folding loop from thereabove and therebelow are provided in two rows before and after a flattening roller that presses the folding loop from the front side thereof is moved along the folding loop of the sheet bundle. The unit thus configured is moved from an outside of one end portion of the sheet bundle in a width direction thereof toward inside thereof and is passed through the other end portion thereof while pinching/pressing the folding loop by means of the pressing roller pairs to thereby flatten a back-folded portion.

Further, Jpn. Pat. Appln. Laid-Open Publication No. 2014-76903 (see corresponding U.S Patent Publication 2014/077436A1) discloses a device provided with a pair of pressing rollers that press a folding loop of a two-folded sheet bundle in a sheet thickness direction and a moving unit that reciprocates the pressing roller pair in a sheet width direction. This device is configured to move the pressing roller pair between a position where they are separated away from each other and a position where they are brought into pressure contact with each other. Upon performing additional folding for the sheet bundle, the moving unit is moved inward from an end portion of the sheet bundle with the pressing roller pair separated away from each other and then presses a fold (folding loop portion) of the sheet bundle by means of the pressing roller pair at the inside position. After the moving unit has passed through one end portion, pressing by the pressing roller pair is released to separate the pressing roller pair away from each other. When being moved again, the moving unit is passed through the one end position of the sheet bundle with the pressing roller pair separated away from each other, then presses starting from the inside position by means of the pressing roller pair, and passes through the other end portion of the sheet bundle. In other words, the pressing against the folding loop of the sheet bundle is started from the inside position in the sheet width direction to the one or the other end portion of the sheet bundle.

The above-described devices that perform the additional folding for the folded sheet bundle carried out from an image forming device or the like have the following problems, respectively.

In the device disclosed in Japanese Patent No. 4,217,640, the roller pair that is previously brought into a pressure contact state is moved along the folding loop. When the pressing roller pair is assembled to the moving unit, it is necessary to individually mount the pressing rollers, springs for biasing the pressing rollers, and a pressurizing arm disposed between the spring and the pressing roller to the moving unit, thus taking much time and trouble for assembly. Further, even if the roller pair is reciprocated along the folding loop many times, the roller pair presses the same position, that is, the folded positions are overlapped in a straight line, with the result that the folded sheet bundle may be opened after the pressing. Thus, an accumulating property of the folded sheet bundle cannot be effectively improved.

Similarly, in the device disclosed in Jpn. Pat. Appln. Laid-Open Publication No. 2014-76903, when the pressing roller pair is assembled to the moving unit, it is necessary to individually mount the pressing rollers, pressurizing springs for biasing the pressing rollers, and a spring bracket disposed between the spring and the pressing roller to the moving unit, thus taking much time and trouble for assembly.

Further, in this device, the pressing roller pair are separated from each other at a standby position outside the folded sheet bundle in the sheet width direction, then moved to the inside position of the folded sheet bundle (where the folding loop exists) in the sheet width direction while being kept in the separated state, and is then made to perform the additional folding at this position by being brought into pressure contact with each other. However, the roller pair presses the same position in the additional folding for the folding loop, that is, the folded positions are overlapped in a straight line, with the result that the folded sheet bundle may be opened after the pressing. Thus, it is difficult to improve the accumulating property of the folded sheet bundle.

SUMMARY OF THE INVENTION

The present invention has been made in view of the above problems, and a first object of the present invention is to prevent a sheet accumulation amount from being reduced due to opening of the folded sheet bundle in an accumulated state by changing stepwise a folding position to direct a folding direction inward and to facilitate assembly by enabling mounting of a first unit including a pressing member and the like as a unit to a second unit.

A second object of the present invention is, in a configuration in which a plurality of rows of pressing roller pairs for pressing the folding loop are disposed with interval between the pressing roller pairs (interval between the upper rollers and the lower rollers) reduced stepwise in a predetermined roller arrangement direction, to accurately mount a guide member for preventing a sheet end portion from being rolled up between the pressing rollers of adjacent rows.

A third object of the present invention is, in a configuration in which a plurality of rows of pressing roller pairs for pressing the folding loop are disposed, to accurately mount a guide member for preventing a sheet end portion from being rolled up between the pressing rollers of adjacent rows.

To achieve the first object, the present invention has the following configuration.

That is, a sheet processing device includes a plurality of first units and a second unit. The first units each include, as one unit, a pressing member that presses the folding loop, a frame that movably holds the pressing member in a sheet pressing direction, and an elastic member that is disposed between the frame and the pressing member so as to bias the pressing member in the sheet pressing direction. The second unit supports, as one unit, a plurality of rows of the first units such that the first units of each row are arranged, as a pair, so as to be opposed to each other and that an interval between the pair is reduced stepwise from a downstream side to an upstream side in a moving direction of the second unit.

To achieve the second object, in the sheet pressing device, a support unit (second unit) includes, between pressing rollers (first units) of adjacent rows in the moving direction, a guide member that guides the folding loop.

To achieve the third object, the sheet pressing device includes a guide plate disposed between the pressing members of adjacent rows in the moving direction of the support unit so as to guide the folding loop. The guide plate is positioned by the pressing roller therebefore or thereafter.

According to the above configuration, the pressing rollers are mounted to the moving support unit such that the interval thereof is gradually reduced, so that the first pressing position for the folding loop and the second pressing position are different from each other. As a result, folding lines are pressed inward in the thickness direction to suppress the folded sheet bundle from being opened.

Further, by enabling mounting of the first unit including the pressing member and the like as a unit to the moving second unit, assembly work is facilitated.

Further, in a configuration in which a plurality of rows of the pressing roller pairs for pressing the folding loop are disposed, a guide member for guiding the folding loop between the pressing rollers of the adjacent rows, thereby preventing a sheet end portion from being rolled up between the pressing rollers of adjacent rows.

Further, in a configuration in which a plurality of rows of the pressing roller pairs for pressing the folding loop are disposed, a guide member for preventing a sheet end portion from being rolled up between the pressing rollers of adjacent rows can be mounted accurately.

BRIEF DESCRIPTION OF THE DRAWINGS

FIGS. 9A and 9B are views for explaining a pressing roller unit supported by the support unit illustrated in FIGS. 6 and 7 and the guide plate attached to the roller unit, in which FIG. 9A is a perspective view illustrating a state where the guide plate is positioned with respect to a second upper pressing roller unit, and FIG. 9B is a cross-sectional view of FIG. 9A;

FIGS. 10A and 10B are views illustrating another embodiment of the positioning between the pressing roller unit and the guide plate, in which FIG. 10A is a perspective view illustrating a state where the guide plate is positioned with respect to a first upper pressing roller unit, and FIG. 10B is a cross-sectional view of FIG. 10A;

FIGS. 14A to 14D are explanatory views illustrating a folded sheet booklet that has been stepwise-folded by the stepwise folding processing illustrated in FIGS. 11 to 13 and has a plurality of fold lines as a result of the stepwise folding, in which FIG. 14A is a view illustrating a state where the folded sheet booklet is pressed between the first upper and lower pressing rollers, FIG. 14B is a view illustrating a state where the folded sheet booklet is pressed between the second upper and lower pressing rollers, FIG. 14C is a view illustrating a state where the folded sheet booklet is pressed between the third upper and lower pressing rollers, and FIG. 14D is a view illustrating the folded sheet booklet obtained as a result of the stepwise folding.

DESCRIPTION OF THE PREFERRED EMBODIMENTS

The present invention will be described in detail below based on an illustrated embodiment. Am image forming system illustrated in FIG. 1 includes an image forming device A and a sheet processing device B. The sheet processing device B incorporates therein a stepwise folding unit 50.

[Configuration of Image Forming Device]

Figure 1:
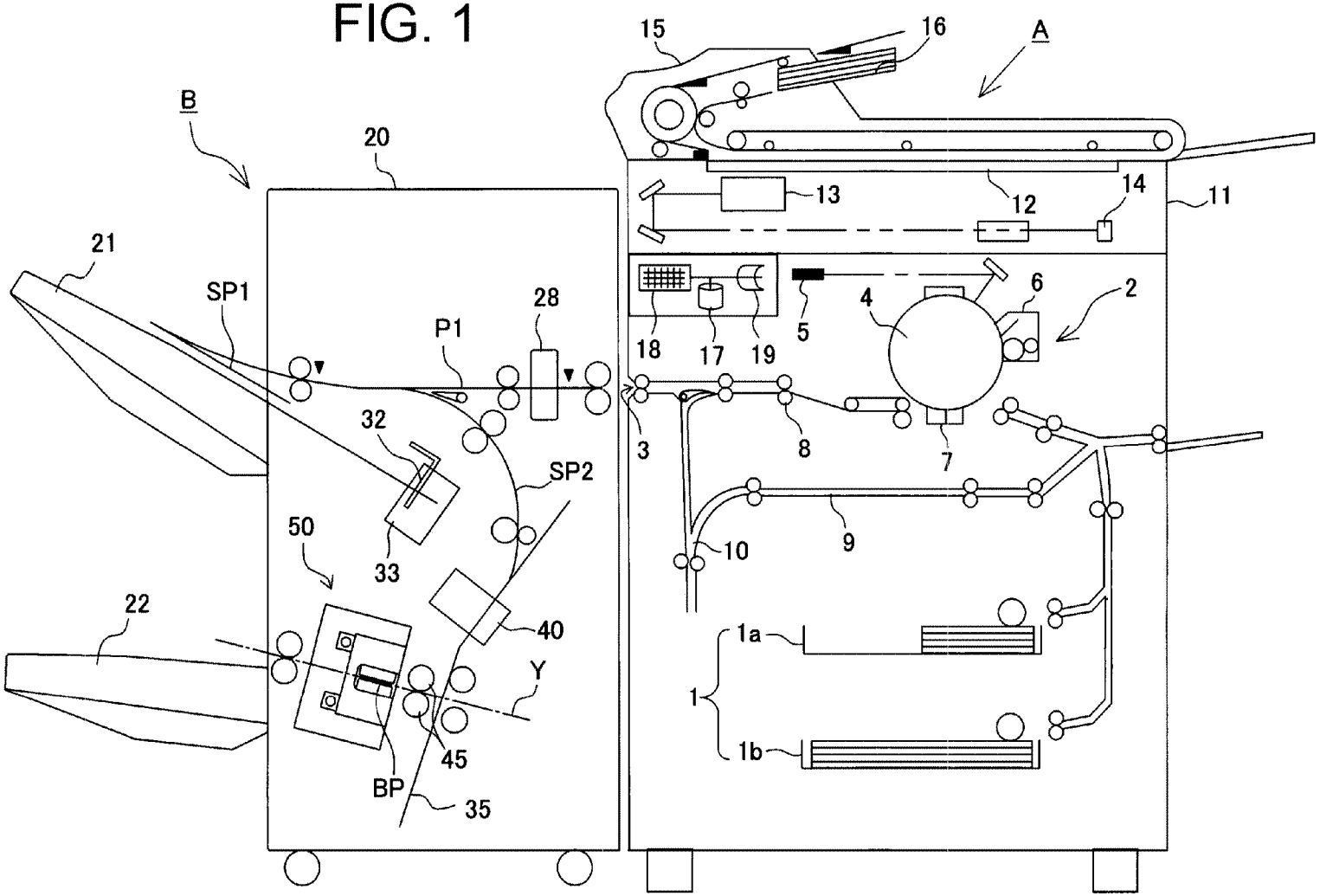
FIG. 1 is an explanatory view of an entire configuration of an image forming system constituted by an image forming device and a sheet processing device incorporating a stepwise folding unit according to the present invention.

The image forming device A illustrated in FIG. 1 feeds a sheet from a sheet supply section 1 to an image forming section 2, performing printing for the sheet in the image forming section 2, and carries out the resultant sheet from a main body sheet discharge port 3. In the sheet supply section 1, sheets of a plurality of sizes are housed in sheet cassettes 1*a* and 1*b*, respectively, and sheets of a specified size are fed to the image forming section 2 while being separated one from another. The image forming section includes, for example, an electrostatic drum 4, a print head (laser emitter) 5, a developing unit 6, a transfer charger 7, and a fixing unit 8. The print head 5, the developing unit 6, the transfer charger 7, and the fixing unit 8 are disposed around the electrostatic drum 4. In this image forming section 2, the laser emitter 5 forms an electrostatic latent image on the electrostatic drum 4, the developing unit 6 makes toner adhere to the obtained electrostatic latent image, the transfer charger 7 transfers an image onto the sheet, and the fixing unit 8 thermally fixes the image to the sheet. The sheets with the thus formed image are sequentially carried out from the main body sheet discharge port 3. A reference numeral 9 is a circulation path for double-sided printing. More specifically, the sheet on a front side of which the image has been printed is fed from the fixing unit 8, reversed in a main body switchback path 10, and enters the circulation path 9, along which the sheet is fed once again to the image forming section 2 for printing on a back side of the sheet. The thus double-side printed sheet is reversed in the main body switchback path 10 and carried out from the main body sheet discharge port 3.

A reference numeral 11 is an image reading device. The image reading device 11 scans a document sheet set on a platen 12 using a scan unit 13, and light reflected from the document and passing through a reflective mirror and a condenser lens is electrically read by a photoelectric conversion element 14. This image data is subjected to, e.g., digital processing in an image processing section, transferred to a data storage section 17, from which an image signal corresponding to the resultant image data is transmitted to the laser emitter 5. A reference numeral 15 is a document feeder that feeds a document sheet housed in a document stacker 16 to the platen 12.

A controller is provided in the image forming device A having the above configuration, and image formation conditions, for example, print-out conditions such as sheet size designation, color/monochrome printing designation, number-of-copies designation, one-side/two-side printing designation, and scaling printing designation are set through a control panel 18. Further, in the image forming device A, image data read by the scan unit 13 or image data transferred from an external network is stored in the data storage section 17. The image data is transferred from the data storage section 17 to a buffer memory 19, from which data signals corresponding to the image data are sequentially transmitted to the laser emitter 5.

Figure 2:
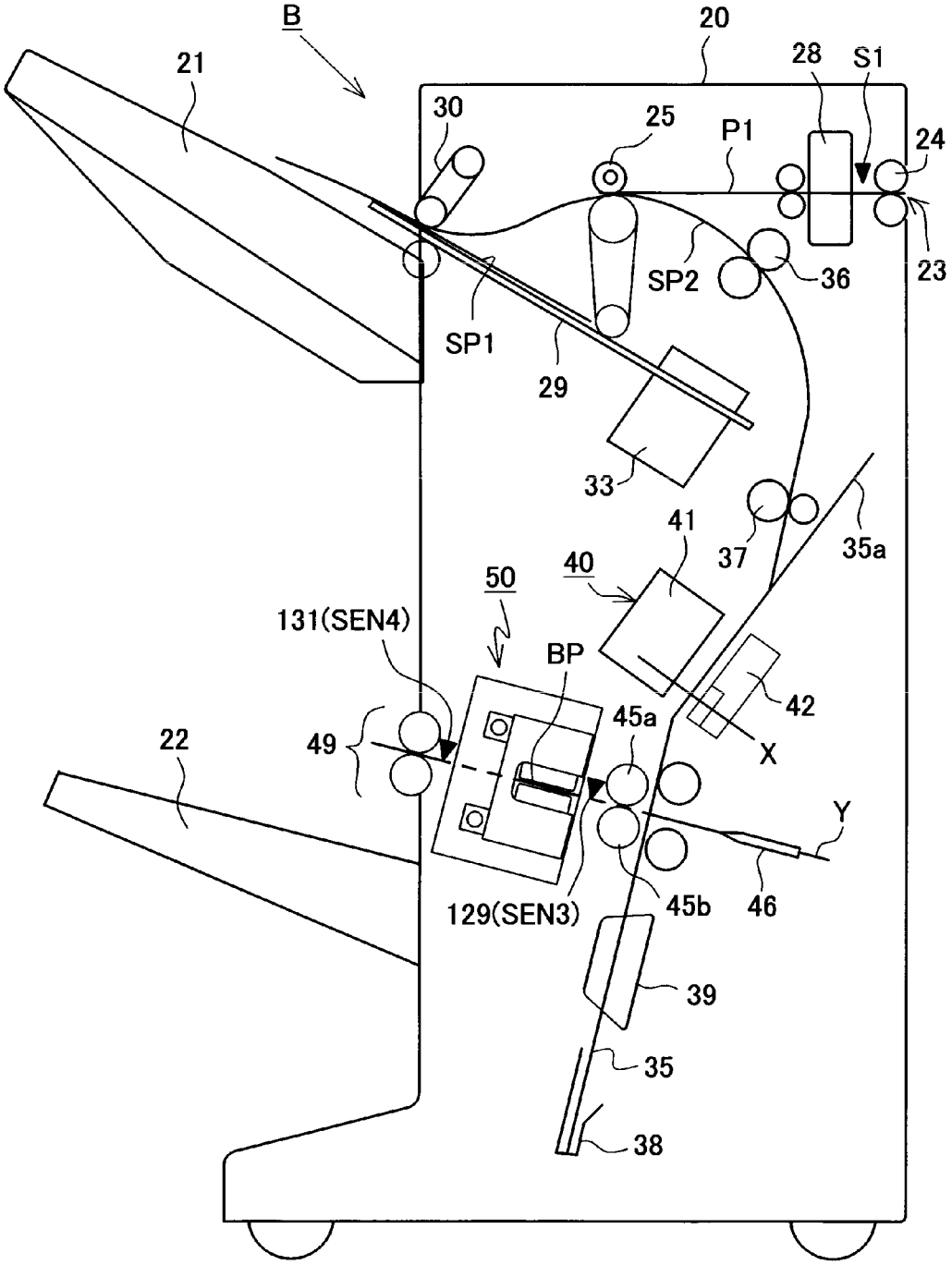
FIG. 2 is an explanatory view of an entire configuration of the sheet processing device incorporating the stepwise folding unit according to the present invention.

As illustrated in FIG. 2, the sheet processing device B connected to the above-described image forming device A includes, in a casing 20 thereof, first and second sheet discharge trays 21 and 22 and a sheet carry-in path P1 having a carry-in port 23 connected to the main body sheet discharge port 3.

The sheet carry-in path P1 is constituted by a straight line path extending in a substantially horizontal direction. Further, first and second switchback conveying paths SP1 and SP2 are branched from the sheet carry-in path P1, along which the sheet is conveyed in a reverse direction to the conveying direction of the sheet conveyed on the sheet carry-in path P1. The first switchback conveying path SP1 is branched from the sheet carry-in path P1 at a path downstream side, and the second switchback path SP2 is branched from the sheet carry-in path P1 at a path upstream side. The first and second switchback conveying paths SP1 and SP2 are distanced from each other.

In such a path configuration, in the sheet carry-in path P1, there are disposed a carry-in roller 24 and a sheet discharge roller 25. The sheet discharge roller 25 is configured to be rotatable in normal and reverse directions. Further, in the sheet carry-in path P1, there is disposed a path switching piece (not illustrated) for guiding the sheet to the second switchback conveying path SP2, and the piece is coupled to an operation means such as a solenoid. Further, the sheet carry-in path P1 has, on the downstream side of the carry-in roller 24, a single-sheet punching unit 28 for punching the sheets fed from the carry-in port 23 one by one.

[Configuration of First Switchback Conveying Path SP1]

As illustrated in FIG. 2, the first switchback conveying path SP1 is configured as follows. The sheet carry-in path P1 is provided, at its exit end, with the sheet discharge roller 25 and a processing tray 29 on which the sheets fed by the sheet discharge roller 25 are stacked and supported. There is disposed, above the processing tray 29, a normal/reverse rotation roller 30 capable of moving up and down between a position to come into contact with the sheet on the tray and a standby position spaced apart therefrom. The normal/reverse rotation roller 30 is controlled to rotate in a clockwise direction in FIG. 2 when the sheet approaches the processing tray 29 to which the normal/reverse rotation roller 30 is coupled, and to rotate in a counterclockwise direction after a sheet rear end passing through the sheet discharge roller 25 enters the processing tray 29. Thus, the first switchback conveying path SP1 is positioned above the processing tray 29. An end face stapler 33 is disposed at a rear end portion of the processing tray 29 in the sheet discharge direction. The stapler 33 staples a sheet bundle on the processing tray 29 at one or more positions of a rear end edge of the sheet bundle. The staple-bound sheet bundle is discharged onto the first sheet discharge tray 21.

[Configuration of Second Switchback Conveying Path SP2]

The following describes a configuration of the second switchback conveying path SP2 branched from the sheet carry-in path P1. The second switchback conveying path SP2 is a conveying path for guiding a switchback-conveyed sheet. That is, in a state where the sheet is nipped by the sheet discharge roller 25, rotation of the sheet discharge roller is changed from the normal rotation to the reverse rotation, with the result that the sheet is switchback-conveyed along the switchback conveying path SP2. As illustrated in FIG. 2, the second switchback conveying path SP2 is located in a substantially vertical direction inside the casing 20. A conveying roller 36 is located at an inlet of the second switchback conveying path SP2, and an exit conveying roller 37 is located at an outlet of the second switchback conveying path SP2. A stacker section 35 constituting a second processing tray that aligns and temporarily stacks the sheets fed along the second switchback conveying path SP2 is provided downstream of the second switchback conveying path SP2. The illustrated stacker section 35 includes a conveying guide that transfers the sheet. A saddle stitching stapler 40 and a folding roller 45 are arranged along the stacker section 35. The configuration of these components will be sequentially described below.

[Configuration of Stacker Section]

The stacker section 35 is formed of a guide member that guides the sheet being conveyed. The stacker section 35 is configured such that the sheets are stacked and housed thereon. The illustrated stacker section 35 is connected to the second switchback conveying path SP2 and located in a center portion of the casing 20 so as to extend in the substantially vertical direction. This allows the device to be compactly configured. The stacker section 35 is shaped to have an appropriate size to house maximum sized sheets. In particular, the illustrated stacker section 35 is curved or bent so as to project toward an area in which the saddle stitching stapler 40 and the folding roller 45 (45*a*, 45*b*) to be described later are arranged.

A switchback approaching path 35*a* is connected to a conveying direction rear end of the stacker section 35. The switchback approaching path 35*a* overlaps the outlet end of the second switchback conveying path SP2. This is to allow the leading end of a carried-in (succeeding) sheet fed from the exit conveying roller 37 on the second switchback conveying path SP2 to overlap the rear end of the stacked (preceding) sheets supported on the stacker section 35 to ensure the page order of the stacked sheets. A leading end regulating member (hereinafter, referred to as stopper 38) as a stopper means for regulating a sheet leading end of the sheet in the conveying direction is located downstream of the stacker section 35. The stopper 38 is supported by a guide rail and the like so as to be movable along the stacker section 35. The stopper 38 is configured to be movable to a position where the sheet is carried-in the stacker section 35 by means of a not illustrated shift means, a position where the sheet bundle is bound at a center thereof in the stacking direction, and to a position where the sheet bundle is folded by the folding roller 45. Further, an aligning means 39 for aligning the sheets is provided in the middle of the stacker section 35 in the sheet conveying direction. The aligning means 39 presses a side edge of the sheet for alignment every time the sheet is carried in.

[Saddle Stitching Stapler]

The saddle stitching stapler 40 positioned above the stacker section 35 includes a driver unit 41 and a clincher unit 42 which are arranged opposite to each other with respect to the stacker section 35. The driver unit 41 drives a staple into a sheet bundle. The clincher unit 42 bends leg portions of the driven staple in a direction facing each other. With this configuration, the sheet bundle is bound at a binding position X illustrated in FIG. 2 corresponding to the half of a sheet length.

The saddle stitching stapler 40 may perform the binding not only by using a metallic staple, but also by using a paper-made staple, by performing press-bonding (without use of the metallic or paper-made staple), or by forming a cut in the paper sheets (without use of the metallic or paper-made staple).

[Folding Roller]

The following describes a configuration of the folding roller 45. As illustrated in FIG. 2, the folding roller 45 for folding the sheet bundle and a folding blade 46 for inserting the sheet bundle into a nip position of the folding roller 45 are disposed at a folding position Y set on the downstream side of the above-described saddle stitching stapler 40. As illustrated in FIGS. 3A to 3D, the folding roller 45 is constituted by an upper pressure contact roller 45*a* and a lower pressure contact roller 45*b* which are brought into pressure contact with each other. The upper and lower pressure contact rollers 45*a* and 45*b* each have a length slightly longer the maximum width of the sheet. The folding roller pair 45 are biased in the pressure contact direction by a not illustrated compression spring. The folding roller pair 45 are each formed of a material, such as rubber, having a comparatively large friction coefficient.

Further, the folding blade 46 configured to be moved toward the pressure contact position of the folding roller pair 45 is disposed so as to be capable of advancing and retreating. After the sheet bundle is saddle-stitched by the saddle stitching stapler 40, the folding blade 46 is moved to push the binding position between the folding roller pair 45 to cause the folding roller pair 45 to be rotated while pressed against each other, whereby the saddle-stitched sheet bundle is folded in two. In the middle of the above folding processing, the folding blade is returned to its original position and waits for the next sheet bundle. A movement path along which the folding blade 46 is moved is illustrated as the folding position Y which coincides with the binding position X of the sheet bundle.

Figure 3A:
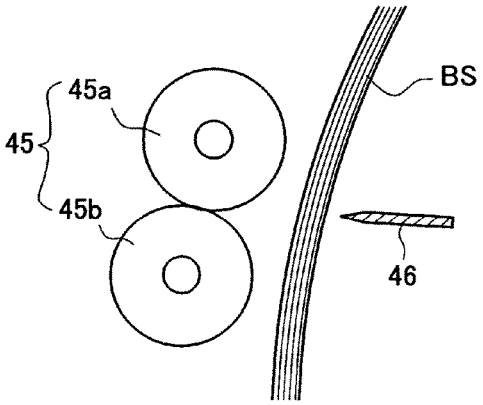
FIGS. 3A to 3D are explanatory views of folding processing performed by a folding roller in the sheet processing device.
Figure 3B:
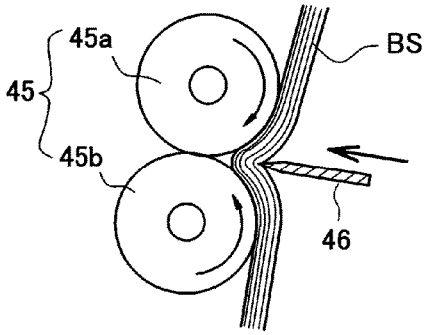

Hereinafter, a procedure of folding processing of the stacked sheet bundle or stacked and saddle-stitched sheet bundle will be described using FIGS. 3A to 3D. The sheets are stopped by the stopper 38 and stacked as a sheet bundle. Then, the stopper 38 is moved upward to allow the saddle stitching stapler 40 to saddle-stitch the sheet bundle at about a center position of the sheet bundle in the sheet conveying direction. After the saddle stitching, the stopper 38 supporting the resultant sheet bundle is moved down and stopped at a position where the sheet binding position coincides with a folding position. This state is illustrated in FIG. 3A. This position coincides with the pressure contact position between the upper and lower pressure contact rollers 45*a* and 45*b* constituting the folding roller 45. Thereafter, the upper and lower pressure contact rollers 45*a* and 45*b* are rotated in the same direction by a not illustrated drive motor, and the folding blade 46 is moved so as to be pushed to the pressure contact position. This state is illustrated in FIG. 3B.

Figure 3C:
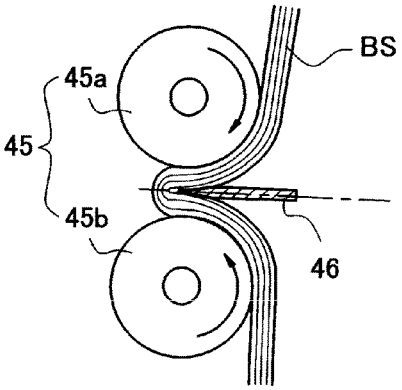
Figure 3D:
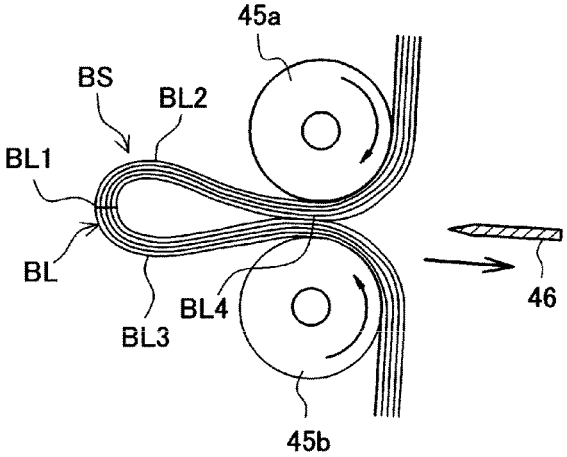

Then, as illustrated in FIG. 3C, the upper and lower pressure contact rollers 45*a* and 45*b* continue being rotated in the same direction, while the folding blade 46 is once stopped before the pressure contact position. Then, the folding blade 46 is retracted in a returning direction. Afterward, when the upper and lower pressure contact rollers 45*a* and 45*b* are further rotated in the same direction, a folded sheet bundle BS to be folded is folded while forming a certain loop BL as illustrated in FIG. 3D. In this state, there are formed a folding loop leading end BL1 which is a fold formed as a result of pushing of the folding blade 46, an upper loop BL2 swelling upward with the folding loop leading end BL1 as a center, a lower loop BL3 swelling downward, and a loop base end portion BL4 that presses the sheets so as to maintain the loop, and the folding operation is once stopped.

The loop at the fold is generated due to action of force for the sheet bundle to be opened outward. Thus, the larger the number of the sheet bundle BS to be folded, the greater the force for the sheet bundle itself to be opened and spread. Accordingly, if no countermeasure is taken, a discharged sheet bundle is opened. So, in the present invention, stepwise folding to be described below is performed, in which the loop portion is additionally pressed in a stepwise manner.

[Stepwise Folding Unit]

Figure 4:
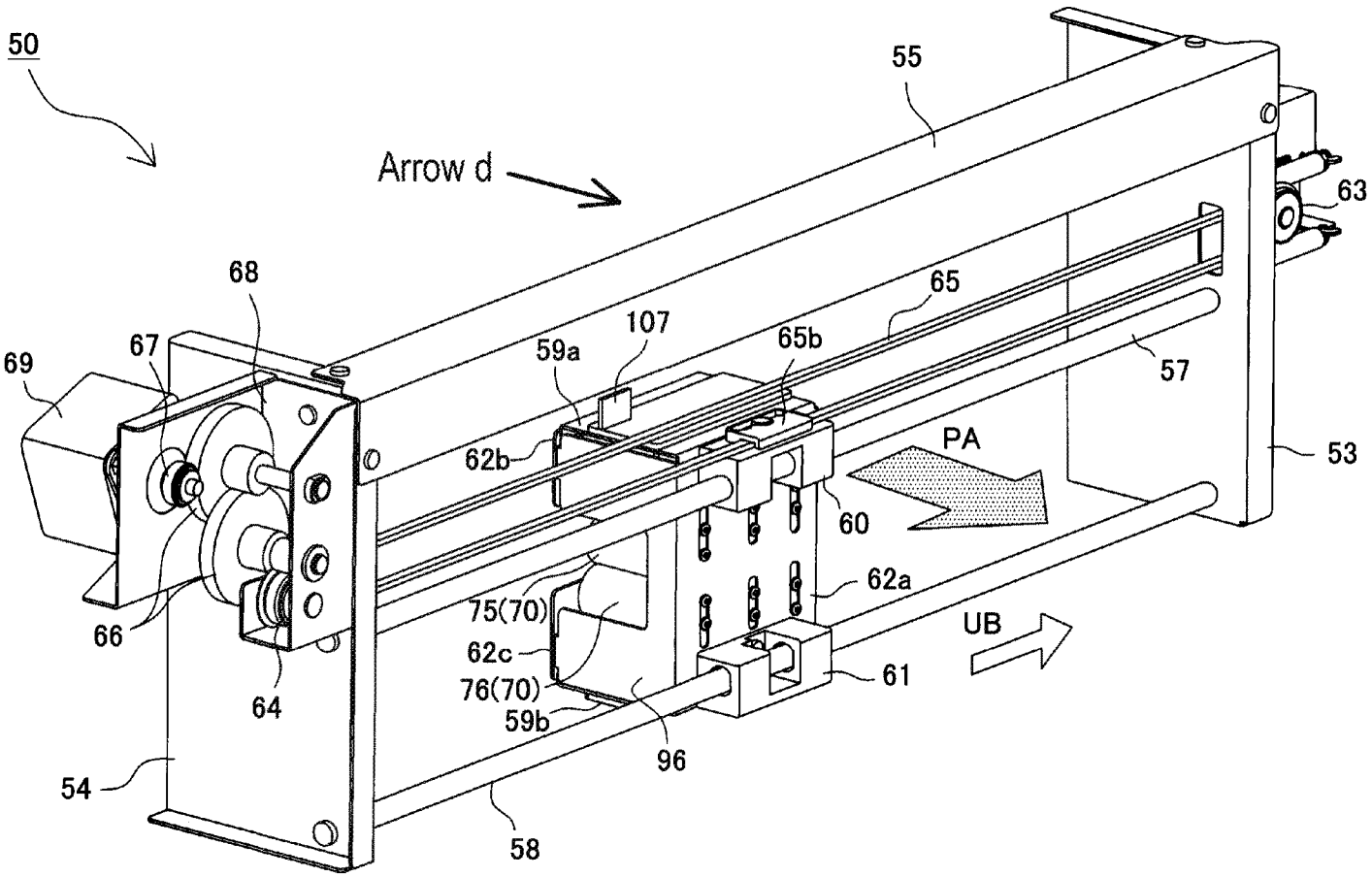
FIG. 4 is a perspective view of a moving mechanism of a support unit that supports the pressing rollers as viewed from a bundle discharge roller side.
Figure 5:
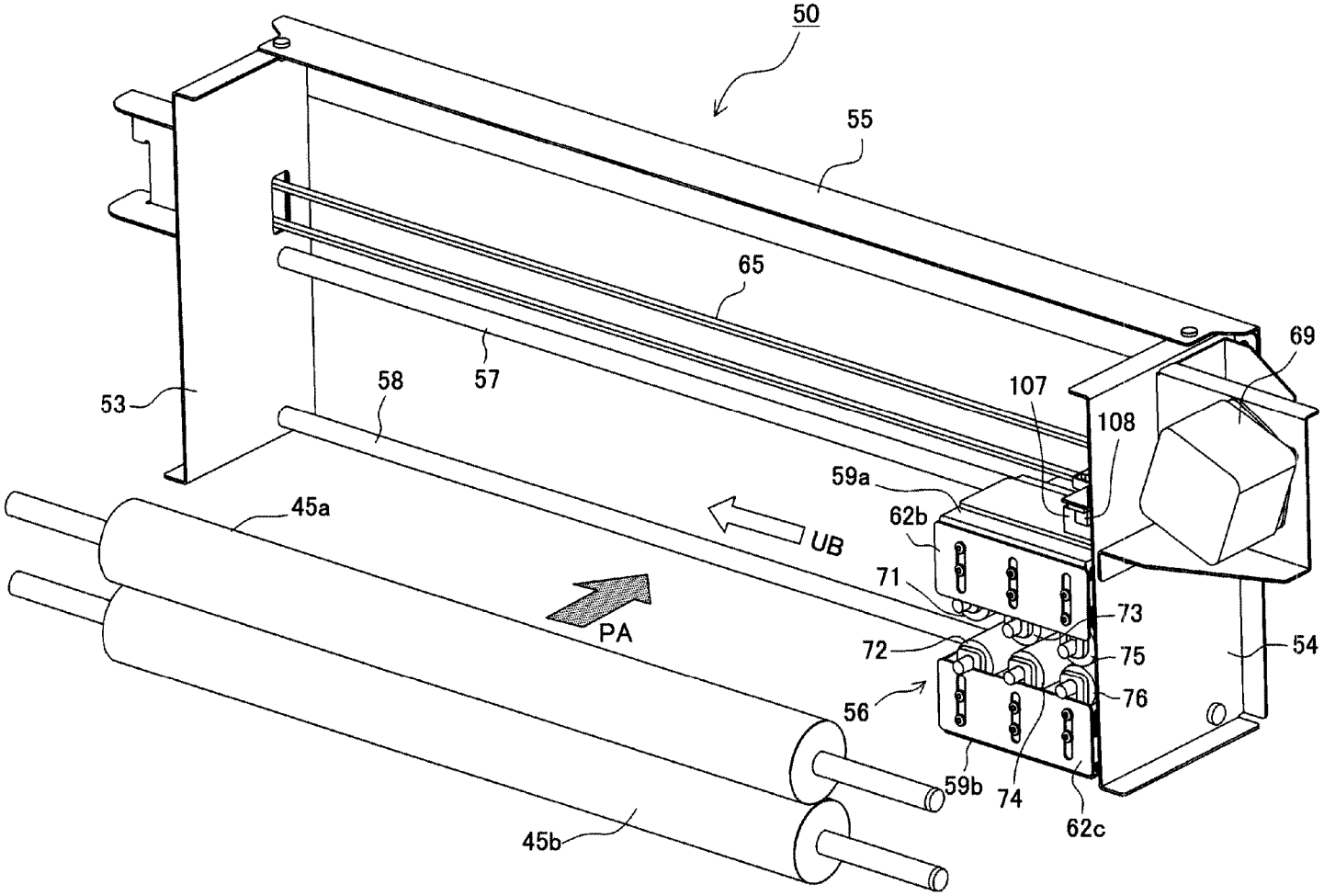
FIG. 5 is a perspective view of the stepwise folding unit as viewed from a direction of an arrow d of FIG. 4.
Figure 6:
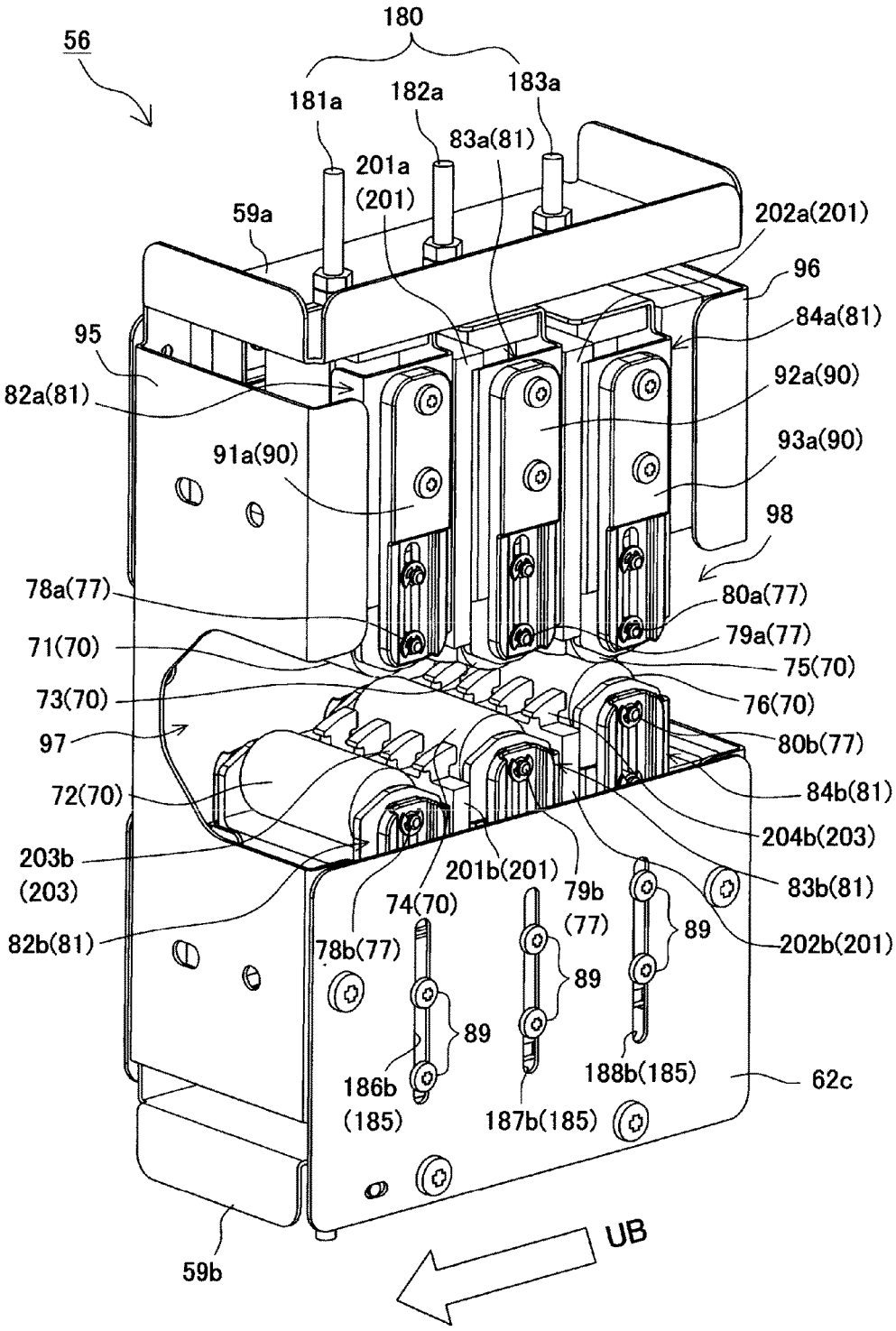
FIG. 6 is a perspective view illustrating the support unit that is moved in the stepwise folding unit while supporting pressing roller units as viewed from the folding roller side.
Figure 7:
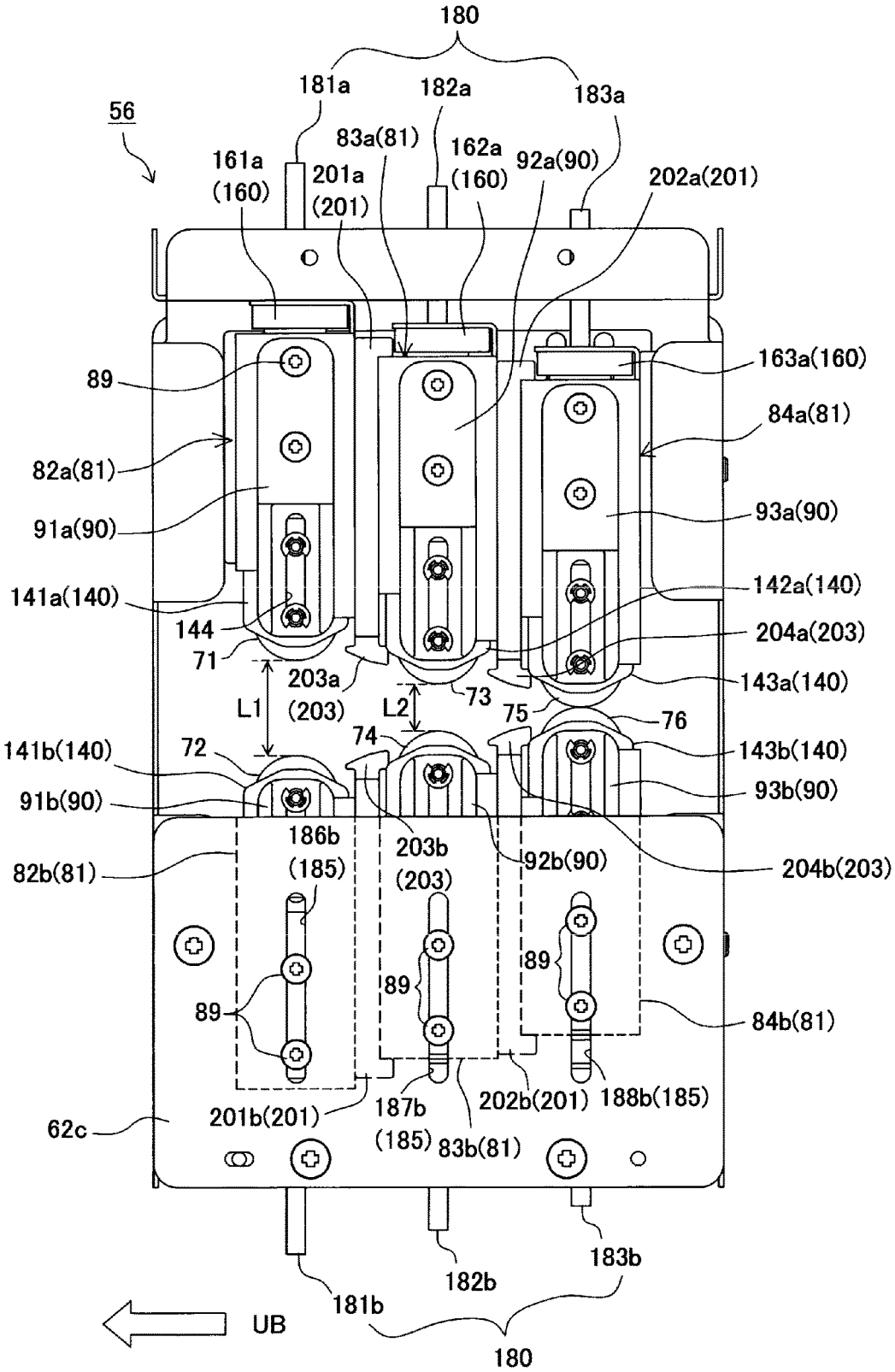
FIG. 7 is a front view of the support unit of FIG. 6 in a state where a front upper base plate is removed therefrom as viewed from the folding roller side.

Hereinafter, a stepwise folding unit 50 constituting a part of the sheet processing device according to the present invention will be described. The stepwise folding unit 50 is a device for preventing the folded sheet bundle BS that has been subjected to the above-described folding processing from being opened. First, a configuration of the stepwise folding unit 50 will be described with reference to FIGS. 4 to 7, followed by description of a relationship between pressing rollers 70 and a guide plate 201 positioned between the pressing rollers 70 with reference to FIGS. 8 to 10A and 10B, and by operation of stepwise folding with reference to FIGS. 11 to 14A to 14D. FIG. 4 is a perspective view of the stepwise folding unit 50 as viewed from the sheet discharge side, FIG. 5 is a perspective view of the stepwise folding unit 50 as viewed from the folding roller 45 side, i.e., a direction indicated by an arrow d of FIG. 4, and FIGS. 6 and 7 are a perspective view and a front view, as viewed from the folding roller 45 side, of a support unit 56 that is provided in the stepwise folding unit 50 so as to be moved along the folding loop in the folded sheet width direction.

First, returning to FIG. 2, the stepwise folding unit 50 is disposed so as to cross a folded sheet conveying path BP provided downstream of the folding roller 45. More in detail, the stepwise folding unit 50 presses for additional folding the folded sheet bundle BS that has been subject to the folding processing by the folding roller 45 by means of a plurality of pressing roller pairs 70 having different intervals. The stepwise folding unit 50 faces the fold of the folded sheet bundle BS extending in the sheet width direction and having a certain loop.

Further, there are disposed, before and after the stepwise folding unit 50 of FIG. 2, a sheet bundle detection sensor (SEN3) 129 that detects a back and a fore edge of the folded sheet bundle folded and conveyed by the folding roller 45 and a bundle discharge sensor (SEN4) 131 that detects discharge of the folded sheet bundle from a bundle discharge roller 49, respectively.

The stepwise folding unit 50 of FIG. 2 is installed between the folding roller 45 and the bundle discharge roller 49 as a sheet bundle discharge member for discharging the sheet bundle BS outside the device; alternatively however, the stepwise folding unit 50 may be disposed downstream of the bundle discharge roller 49 as long as it crosses the folded sheet conveying path BP.

As illustrated in FIG. 4, in the stepwise folding unit 50, a right side plate 53 disposed at one side of the device, a left side plate 54 disposed facing the right side plate 53, and a connecting angle 55 connecting the right side plate 53 and the left side plate 54 constitute the entire frame of the device. A support unit 56 is disposed between the right side plate 53 and the left side plate 54. The support unit 56 supports a plurality of rows of the pressing roller pairs and is reciprocated between the right side plate 53 and the left side plate 54. The support unit 56 configured to be reciprocated is slidably moved along an upper guide rail 57 and a lower guide rail 58 extending between the right side plate 53 and the left side plate 54. More specifically, the support unit 56 is supported such that an upper slide block 60 attached to an upper portion of the support unit 56 is slid along the upper guide rail 57 and a lower slide block 61 attached to a lower portion of the support unit 56 is slid along the lower guide rail 58.

A moving belt 65 is provided above the support unit 56 so as to be stretched between the right side plate 53 and the left side plate 54. As illustrated in FIG. 4, a right pulley 63 that winds the moving belt 65 is provided at the right side plate 53 side, and a left pulley 64 that winds the moving belt 65 is provided at the left side plate 54 side. One end of the moving belt 65 is fixed to a belt fixing portion 65*b* at an upper end of the support unit 56. Thus, when the moving belt 65 is moved to move the belt fixing portion 65*b* from a device front side (left side) to a device back side (right side), the support unit 56 is moved from the device front side (left side) to the device back side (right side) along the upper guide rail 57 and the lower guide rail 58. When the moving belt 65 is moved in the opposite direction, the belt fixing portion 65*b* is also moved in the opposite direction, which moves the support unit 56 in the opposite direction.

In the present invention, in a direction (direction indicated by an arrow UB) that the support unit 56 presses the folding loop in a stepwise manner, the moving start side (left side in FIG. 4) is defined as "upstream side", and the moving end side (right side in FIG. 4) is defined as "downstream side". That is, the plurality of rows of the pressing roller pairs 70 are arranged such that the interval therebetween is gradually reduced from the downstream side to the upstream side.

The left pulley 64 that winds the moving belt 65 is mounted to a motor gear unit 68 provided on the left side plate 54 and connected to a unit drive motor 69 configured to be rotatable in normal and reverse directions. Rotation drive of the unit drive motor 69 is transmitted from a motor output gear 67 to a transmission gear 66 provided in the motor gear unit 68, and then to the left pulley 64 of the moving belt 65.

Thus, selecting a rotating direction of the unit drive motor 69 allows the support unit 56 to be moved selectively in the directions from the device front side (left side) to the device back side (right side) to press the folding loop and, conversely, from the device back side (right side) to the device front side (left side) for returning. As illustrated in FIG. 5, a unit flag 107 is provided near an upper end portion of the support unit 56 on the left side plate 54 side. The unit flag 107 indicates that the support unit 56 is situated at a home position near the left side plate 54. When the unit flag 107 is detected by a home position sensor 108, it can be determined that the support unit 56 is situated at the home position. From the home position, the support unit 56 is moved in the direction indicated by the arrow UB to press the folding loop in a stepwise manner.

When the support unit 56 is moved from the home position in the arrow UB direction, a position of the support unit 56 is determined by a not illustrated pulse generator incorporated in the unit drive motor 69, whereby it is determined that the support unit 56 is situated at a returning position near the right side plate 53. When the support unit 56 is situated at the returning position, the unit drive motor 69 is rotated in the reverse direction to move the support unit 56 toward the home position. Thus, the support unit 56 is a moving member that is moved by means of the moving belt 65 and the like.

[Support Unit]

The following describes the support unit 56 configured to be moved to the left and right in the drawing. As illustrated in FIG. 5, which is a perspective view as viewed from the folding roller 45 side, the support unit 56 is surrounded by a unit base plate 62*a* (FIG. 4) constituting a back surface side of the unit, front upper and lower base plates 62*b* and 62*c* which are separated up and down, a preceding unit side plate 95, a following unit side plate 96, a unit top plate 59*a*, and a unit bottom plate 59*b*.

As illustrated in FIG. 6, the preceding unit side plate has a preceding side plate opening 97 having a comparatively large size, and the following unit side plate has a following side plate opening 98 having a size smaller than the preceding side plate opening 97. These openings 97 and 98 allow the support unit 56 to be moved along the fold of the sheet bundle with the fold inserted into the support unit 56. That is, the folding loop BL is inserted into the support unit 56 for pressing from the preceding side plate opening 97 side.

Figure 8:
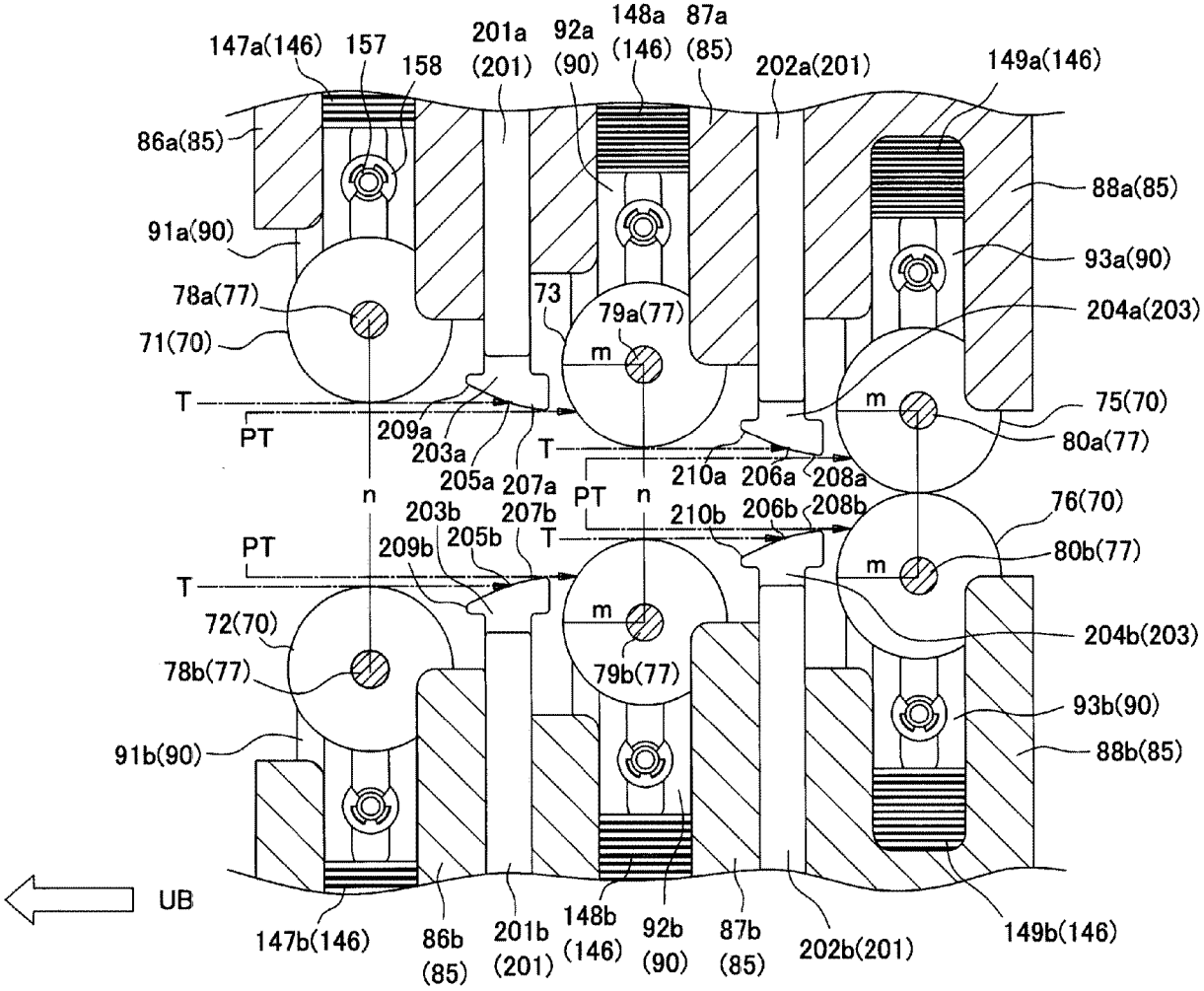
FIG. 8 is an enlarged view illustrating an area around the pressing roller pairs and the guide plates.

The following describes an inside of the support unit with reference to FIGS. 6 to 8. For descriptive convenience, the front upper base plate 62*b* is omitted.

A plurality of rows, in the present embodiment, three rows of pressing roller pairs (collectively designated by a reference numeral 70) are arranged from the preceding unit side plate 95 side toward the following unit side plate 96. An interval (in the folding loop thickness direction) between the pressing roller pair 70 differs for each row. That is, the pressing roller pair 70 of a first row includes a first upper pressing roller 71 and a first lower pressing roller 72 which are disposed opposite to and spaced apart from each other by a predetermined interval. The first upper pressing roller 71 and the first lower pressing roller 72 are separated at an equal distance from the folding position of the sheet bundle. These pressing rollers 70 each constitute a part of a pressing roller unit 81 as described below. Conversely, the pressing roller unit 81 supports the pressing roller 70.

The pressing roller unit 81 for the first upper pressing roller 71 is configured as follows. That is, a first upper pressing roller shaft 78*a* which is a shaft of the first upper pressing roller 71 is mounted to a first upper pressing roller support arm 91*a* that support the first upper pressing roller shaft 78*a*. The first upper pressing roller support arm 91*a* is mounted to a first upper pressing roller frame 86*a* formed of a sheet metal of a mold member and bent into a hollow shape to make a unit.

Further, a first upper pressing roller pressing spring 147*a* is interposed between the first upper pressing roller 71 and a top plate of the first upper pressing roller frame 86*a* so as to always bias the first upper pressing roller 71 in a direction pressing the folding loop (downward direction in FIG. 8). Further, a support arm elongated hole 94 is formed in the first upper pressing roller support arm 91*a*.

Thus, the first upper pressing roller shaft 78*a* can be moved within a range of the support arm elongated hole 94. In a mounting state to the support unit 56, the support arm elongated hole 94 regulates movement of the first upper pressing roller 71.

The pressing roller unit 81 for the first lower pressing roller 72 at a position opposite to the first upper pressing roller 71 is configured as follows. That is, a first lower pressing roller shaft 78*b* which is a shaft of the first lower pressing roller 72 is mounted to a first lower pressing roller support arm 91*b* that support the first lower pressing roller shaft 78*b*. The first lower pressing roller support arm 91*b* is mounted to a first lower pressing roller frame 86*b* formed of a sheet metal of a mold member and bent into a hollow shape to make a unit.

Further, a first lower pressing roller pressing spring 147*b* is interposed between the first lower pressing roller 72 and a top plate of the first lower pressing roller frame 86*b* so as to always bias the first lower pressing roller 72 in a direction pressing the folding loop (upper direction in FIG. 8).

Further, a support arm elongated hole 94 is formed in the first lower pressing roller support arm 91*b*. Thus, the first lower pressing roller shaft 78*b* can be moved within a range of the support arm elongated hole 94. In a mounting state to the support unit 56, the support arm elongated hole 94 regulates upward movement of the first lower pressing roller 72.

As is the case with the first row, a second upper pressing roller unit 83*a* supporting a second upper pressing roller 73 of the second row and a second lower pressing roller unit 83*b* supporting a second lower pressing roller 74 of the second row are opposed to each other. Similarly, a third upper pressing roller unit 84*a* supporting a third upper pressing roller 75 of the third row and a third lower pressing roller unit 84*b* supporting a third lower pressing roller 76 of the third row each are opposed to each other.

Thus, each pressing roller 70 is supported by the corresponding pressing roller support arm 90 and previously assembled as the pressing roller unit 81 together with the pressing roller pressing spring 146. This unitization facilitates assembly of components including the pressing roller and its peripheral members to the support unit 56. The unit configuration of the pressing roller 70 will be described later once again with reference to FIGS. 9A and 9B.

[Relationship Between Pressing Roller Pair in Support Unit]

The following describes a relationship between the pressing roller pair 70 in the support unit. As illustrated clearly in FIG. 7, an interval L1 between the first upper pressing roller 71 and the first lower pressing roller 72 is always kept constant. In the present embodiment, the interval L1 is set to about 14 mm. Further, the first upper pressing roller pressing spring 147*a* and the first lower pressing roller pressing spring 147*b*, which are illustrated in FIG. 8, are set so as to apply a load of 4.0 kg to the first upper and lower pressing rollers 71 and 72 in a state where the rollers 71 and 72 are brought into contact with each other.

Further, as illustrated in FIG. 7, an interval L2 between the second upper pressing roller 73 and the second lower pressing roller 74 is always kept constant. In the present embodiment, the interval L2 is set to about 7 mm. Further, a second upper pressing roller pressing spring 148*a* and a second lower pressing roller pressing spring 148*b*, which are illustrated in FIG. 8, are set so as to apply a load of 4.0 kg to the second upper and lower pressing rollers 73 and 74 in a state where the rollers 73 and 74 are brought into contact with each other.

As described above, the first upper and lower pressing rollers 71 and 72 of the first row are spaced apart from each other by a predetermined interval L1 (about 14 mm, in the present embodiment), and the second upper and lower pressing rollers 73 and 74 of the second row are spaced apart from each other by a predetermined interval L2 (about mm, in the present embodiment). That is, the movement range of the each pressing roller 70 is regulated by the support arm elongated hole of the pressing roller support arm 90 that supports the pressing roller 70. Further, mounting positions of the pressing roller units 81 of the first and second rows to the support unit are set based on the support arm elongated hole.

With this configuration, the positions of the pressing roller pairs 70 of the first and second rows are regulated such that the intervals therebetween become equal to or larger than their corresponding predetermined intervals.

However, as illustrated in FIG. 6 to FIGS. 9A and 9B, third upper and lower pressing rollers 75 and 76 of the third row (last row) are always elastically biased so as to be always brought into pressure contact with each other. That is, a position of the pressing roller unit 81 of the third row is regulated such that the roller interval L3 is set to 0. In the present embodiment, a third upper pressing roller pressing spring 149*a* and a third lower pressing roller pressing spring 149*b* are set so as to apply a load of 4.0 kg to the third upper and lower pressing rollers 75 and 76 at the roller contact position. With this configuration, the stepwise folding is performed while a load exceeding 4 kg is applied to both sides of the folding loop (fold BL1 of the loop leading end) of the folded sheet bundle BS. Thus, each pressing roller 70 is biased in a direction pressing the sheet bundle. Operation of the stepwise folding will be described later with reference to FIGS. 11 to 13.

[Guide Plate]

The following describes, with reference to FIGS. 6 to 8, a guide plate disposed between the pressing rollers of adjacent rows so as to guide the folding loop.

As illustrated, a first upper guide plate 201*a* is disposed between the first upper pressing roller 71 of the first row and the second upper pressing roller 73 of the second row, and a second upper guide plate 202*a* is disposed between the second upper pressing roller 73 of the second row and the third upper pressing roller 75 of the third row. Further, at an opposing side with respect to the sheet folding position, a first lower guide plate 201*b* is disposed between the first lower pressing roller 72 of the first row and the second lower pressing roller 74 of the second row, and a second lower guide plate 202*b* is disposed between the second lower pressing roller 74 of the second row and the third lower pressing roller 76 of the third row.

The guide plate 201 has, at a leading end thereof, a guide portion 203 extending up to a peripheral surface of the pressing roller 70. A base end portion side of the guide plate 201 is mounted to the pressing roller unit 81. The mounting structure of the guide plate 201 to the pressing roller unit 81 will be described in detail later. Positions of the guide portions 203 are determined in accordance with the intervals between the pressing roller pairs 70 of the respective rows when the support unit 56 is moved (in the arrow UB direction of FIG. 8) to move the pressing roller pairs 70. More specifically, a funnel cross-sectional shape (an isosceles triangle with the pressing roller pairs of the third row as an apex) is constituted by all the pressing rollers 70 and the guide portions of all the guide plates 201, thereby preventing the folding loop end portion from being rolled up between the pressing rollers of adjacent rows.

The following describes a positional relationship between the pressing roller 70 and the guide portion 203 formed at the leading end of the guide plate 201 with reference especially to FIG. 8.

As illustrated, two pairs of the upper and lower guide plates 201, that is, four guide plates 201 in total are arranged. Among them, the first upper guide plate 201*a* disposed between the first upper pressing roller 71 and the second upper pressing roller 73 will be described. The leading end of the first upper guide plate 201*a* swells to form a first upper guide portion 203*a*, which is located at a position extended from a first upper guide projection portion 211*a* side and between the first upper pressing roller 71 and the second upper pressing roller 73. The first upper guide portion 203*a* has a first upper guide slope 205*a* inclined downward in the drawing from a first upper guide downstream portion 209*a* at the first upper pressing roller 71 side (downstream side) toward the second upper pressing roller 73 side (upstream side). The first upper guide portion 203*a* is thus extended and inclined to prevent the end portion of the folding loop BL from being rolled up or caught between the first upper pressing roller 71 and the second upper pressing roller 73.

The first upper pressing roller 71, the second upper pressing roller 73, and the first upper guide portion 203*a* have the following positional relationship. That is, a tangent line T forming an approximate right angle, at a peripheral surface of the first upper pressing roller 71 which is positioned downstream of the first upper guide slope 205*a*, to a perpendicular line n passing through the first upper pressing roller shaft 78*a* as a center axis of the first upper pressing roller 71 in a direction substantially perpendicular to the moving direction of the support unit 56 supporting the first upper pressing roller 71 crosses the first upper guide slope 205*a*. In other words, an arrow T of FIG. 8 abuts the first upper guide slope 205*a*. The tangent line T in this case only needs to fall within a range where the folding loop BL is guided.

The first upper guide slope 205*a* and the second upper pressing roller 73 positioned upstream thereof have the following positional relationship. That is, a first upper guide upstream portion 207*a* falls within a range of a peripheral surface of the second upper pressing roller 73 positioned upstream of the first upper guide slope 205*a* that is surrounded by a straight line m and a perpendicular line n, the straight line m being a line passing through a second upper pressing roller shaft 79*a* as a center axis of the second upper pressing roller 73 and extending along the moving direction of the support unit 56, the perpendicular line n forming an approximate right angle to the straight line m. In other words, an arrow PT abuts the peripheral surface of the second upper pressing roller 73, and the first upper guide upstream portion 207*a* falls within a range of a lower-left ¼ of the peripheral surface of the second upper pressing roller 73 in FIG. 8.

With this arrangement, the guide portion 203 extends in the moving direction of the support unit 56 so as to expose the peripheral surfaces of the pressing rollers therebefore and thereafter. As a result, the folding loop is guided to a funnel cross-sectional shape (an isosceles triangle with the pressing roller pairs of the third row as an apex), allowing the stepwise folding to be performed comparatively smoothly.

[Mounting of Guide Plate to Pressing Roller Unit]

In the present embodiment, the guide portion of the guide plate 201 has the above positional relationship with the pressing rollers 70, so that an accurate mutual position needs to be calculated.

Figure 9B:
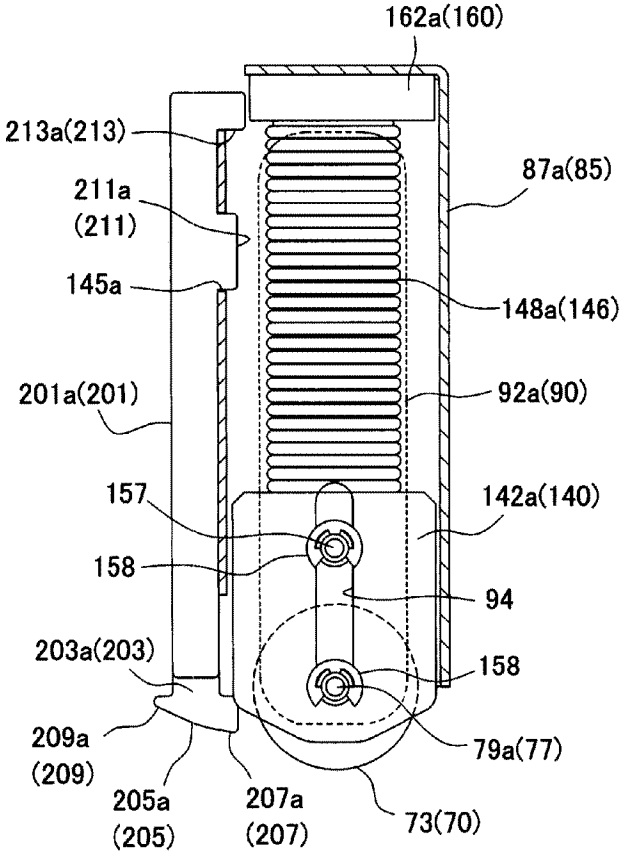
Figure 9A:
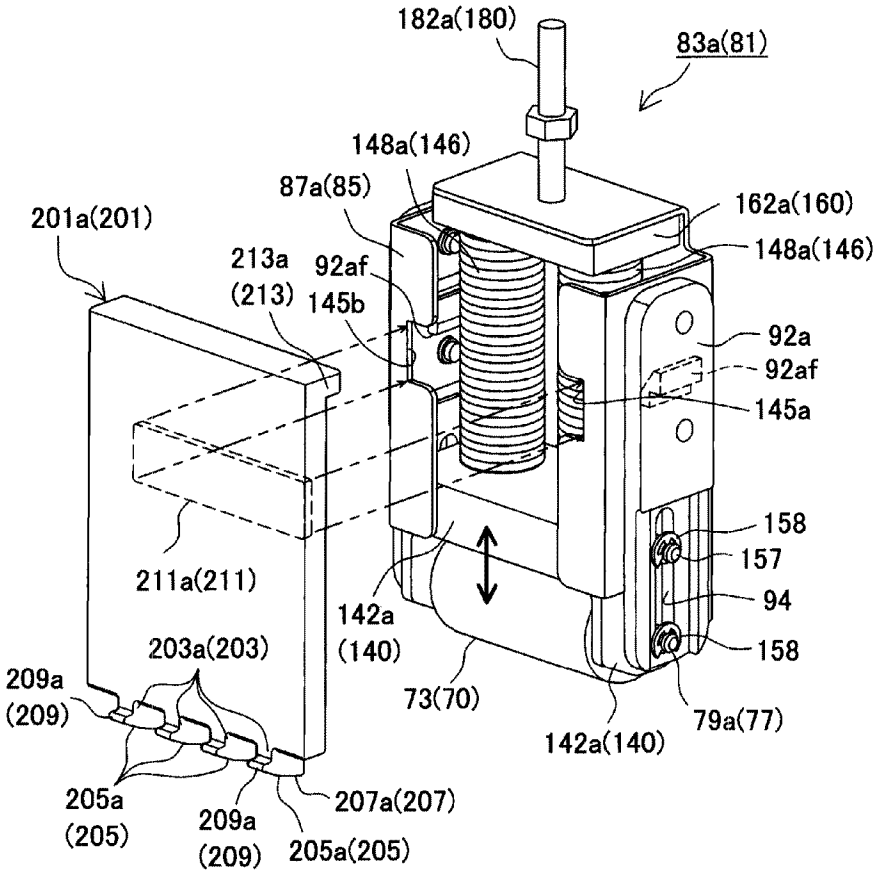
Figure 10B:
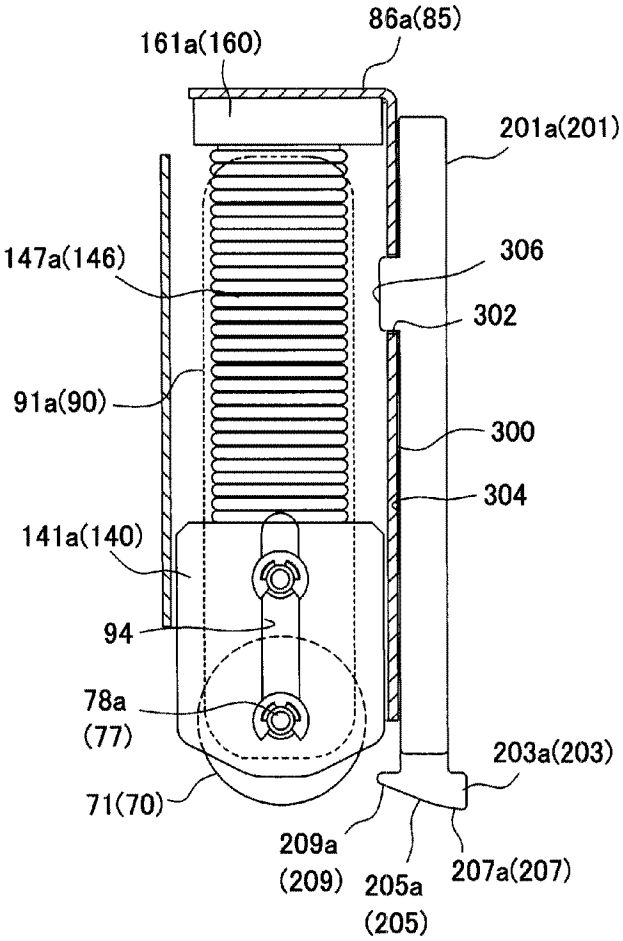
Figure 10A:
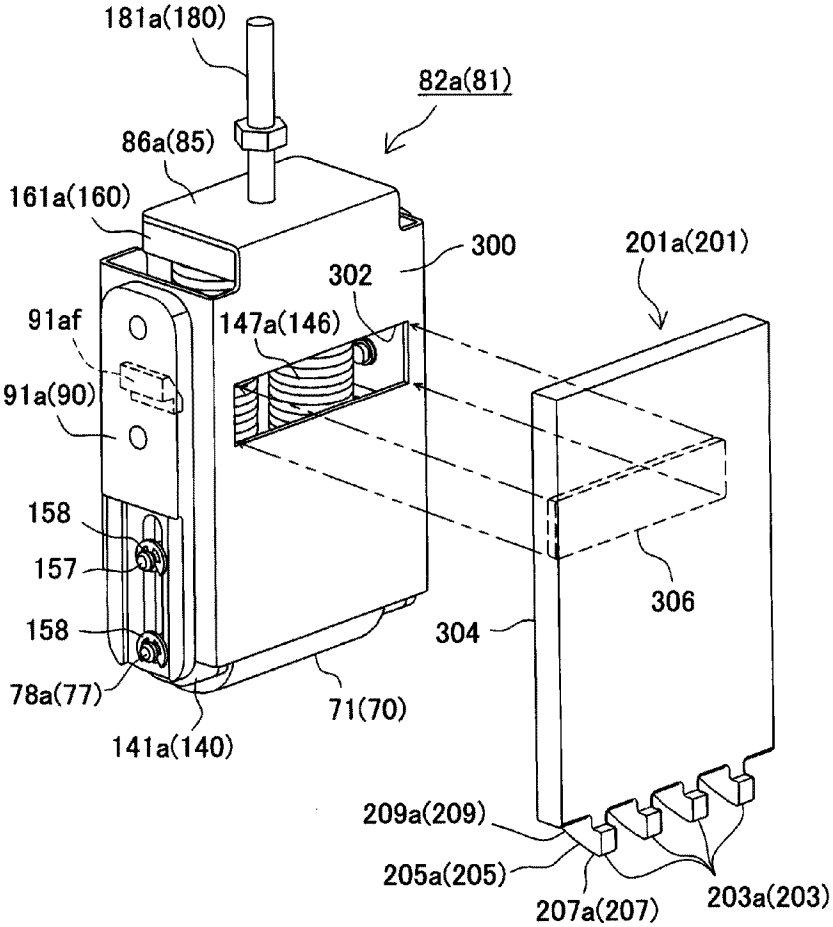

Thus, a mounting configuration as illustrated in FIGS. 9A and 9B is adopted. FIG. 9A is a perspective view illustrating a state where the guide plate is positioned with respect to the second upper pressing roller unit. FIG. 9B is a cross-sectional view for explaining the perspective view of FIG. 9A. FIGS. 10A and 10B are modification of the mounting configuration of FIGS. 9A and 9B.

Here, an additional description will be given of the second upper pressing roller unit 83*a*. As illustrated in FIG. 9A, the second upper pressing roller unit 83*a* has the rotatably-configured second upper pressing roller 73 that presses the folding loop BL and a second upper pressing roller frame 87*a* (frame) that holds a second upper pressing roller bracket 142*a*. The second upper pressing roller bracket 142*a* supports the second upper pressing roller 73 in such a manner that the second upper pressing roller bracket 142*a* can slide along an inner wall thereof.

Left and right two second upper pressing roller pressing springs 148*a* (elastic spring) are mounted between the second upper pressing roller frame 87*a* and the second upper pressing roller bracket 142*a* through a second upper pressing roller spring bracket 162*a*. The second upper pressing roller pressing springs 148*a* bias the second upper pressing roller 73 in the sheet pressing direction as illustrated in FIG. 9A.

A second upper pressing roller support arm 92*a* is mounted to left and right surfaces of the illustrated second upper pressing roller frame 87*a*. The second upper pressing roller support arm 92*a* supports the second upper pressing roller shaft 79*a* of the second upper pressing roller 73 such that the second upper pressing roller shaft 79*a* can be moved along the support arm elongated hole 94. More specifically, the second upper pressing roller support arm 92*a* is locked to an opening provided at a side portion of the second upper pressing roller frame 87*a* by an arm hook 92*af* which is fitted to the opening. In the support arm elongated hole 94 of the second upper pressing roller support arm 92*a*, a roller bracket shaft 157 fixedly provided to the second upper pressing roller bracket is movably mounted by an E-ring. These components are unitized to constitute the second upper pressing roller unit 83*a*.

Thus, as illustrated in FIG. 9A, the second upper pressing roller support arm 92*a* is locked by the arm hook 92*af* to be assembled to the second upper pressing roller unit 83*a*. Thus, in this unitized state, the second upper pressing roller unit 83*a* can be easily fixed to the support unit 56 by screws 89. All the pressing roller units 81 illustrated in FIGS. 6 to 8 have the same configuration.

The second upper pressing roller unit 83*a* is screwed with, at its top, a second upper pressing roller unit adjustment screw 182*a* so as to allow positional adjustment with respect to the support unit 56.

As described above, the second upper pressing roller unit 83*a* obtained by unitizing the second upper pressing roller 73, the second upper pressing roller pressing springs 148*a* that biases the second upper pressing roller 73, and the like can be mounted to the support unit 56, thus facilitating assembly work. Further, the second upper pressing roller unit 83*a* is provided with the second upper pressing roller unit adjustment screw 182*a* that allows upward and downward positional adjustment with respect to the support unit 56. Thus, an optimum position for pressing the folding loop BL can be set.

The following describes a mounting configuration of the first upper guide plate 201*a* to the second upper pressing roller unit 83*a*, the first upper guide plate 201*a* being positioned downstream of the second upper pressing roller unit 83*a* in the moving direction of the support unit 56.

As illustrated in the perspective view of FIG. 9A, an upstream side outer wall of the second upper pressing roller frame 87*a* of the second upper pressing roller unit 83*a* has a frame cut portion (right) 145*a* and a frame cut portion (left) 145*b* each obtained by cutting a part of the frame as illustrated. On the other hand, a first upper guide projection portion 211*a* projecting toward the second upper pressing roller unit 83*a* is formed in a second upper pressing roller unit 83*a* side surface (down stream side surface/back surface) of the first upper guide plate 201*a* at a portion on the mounting portion side above the first upper guide portion 203*a* so as to face the cut portions. Further, as illustrated clearly in the cross-sectional view of FIG. 9B, a guide locking portion 213*a* fitted to an upper end portion of the second upper pressing roller unit 83*a* is provided at an upper end portion (opposite side to the first upper guide portion 203*a*) of the first upper guide plate 201*a*.

As described above, the first upper guide projection portion 211*a* is fitted to the frame cut portion (right) 145*a* and the frame cut portion (left) 145*b* each of which is obtained by cutting a part of the frame as illustrated, and the guide locking portion 213*a* is fitted to the upper end portion of the second upper pressing roller unit 83*a*, whereby the positional relationship between the second upper pressing roller 73 and the first upper guide plate 201*a* can be set at time of unit assembly. As a result, the positional relationship between the first upper guide portion 203*a* of the first upper guide plate 201*a* and the second upper pressing roller 73 can be set accurately.

As illustrated, the first upper guide plate 201*a* is mounted so as to be sandwiched between the second upper pressing roller unit 83*a* and the first upper pressing roller unit 82*a* through the concavo-convex structure and thus can be assembled easily without use of screws and the like.

With the above configuration, the positioning between the first upper guide portion 203*a* of the first upper guide plate 201*a* and the second upper pressing roller 73 can be achieved accurately.

Other guide plates 201 and their upstream side pressing roller units 81 have the same positional relationship and the mounting structure.

As a result, when the plurality of rows of the pressing roller pairs 70 for pressing the folding loop are arranged, it is possible to easily mount the guide plate 201 that prevents the sheet end portion from being rolled up between the pressing rollers of adjacent rows by fitting through the concavo-convex structure while keeping positioning accuracy.

The following describes a modification of the configuration illustrated in FIGS. 9A and 9B with reference to FIGS. 10A and 10B. In the configuration of FIGS. 9A and 9B, the first upper guide plate 201*a* is mounted to the second upper pressing roller unit 83*a* positioned upstream of the first upper guide plate 201*a*; while in the configuration of FIGS. 10A and 10B, the first upper guide plate 201*a* is positioned with respect to and mounted to the first upper pressing roller unit 82*a*.

The first upper pressing roller support arm 91*a* of this modification that holds the first upper pressing roller 71 has the same configuration as that of the second upper pressing roller support arm 92*a*, including a configuration in which it is assembled by an arm hook 91*af* fitted to the cut portion on a side portion of the first upper pressing roller frame 86*a*.

An upstream side cut portion 302 obtained by cutting a frame upstream side surface 300 in a rectangular shape is formed in the first upper pressing roller frame 86*a* of the first upper pressing roller unit 82*a* of FIGS. 10A and 10B. A downstream side projecting portion 306 projecting from a downstream side surface of the first upper pressing roller unit 82*a* is fitted to the upstream side cut portion 302. With this configuration, a positional relationship between the first upper guide portion 203*a* of the upper guide plate 201*a* and the first upper pressing roller 71 can be set accurately.

[Operation of Support Unit]

Figure 11:
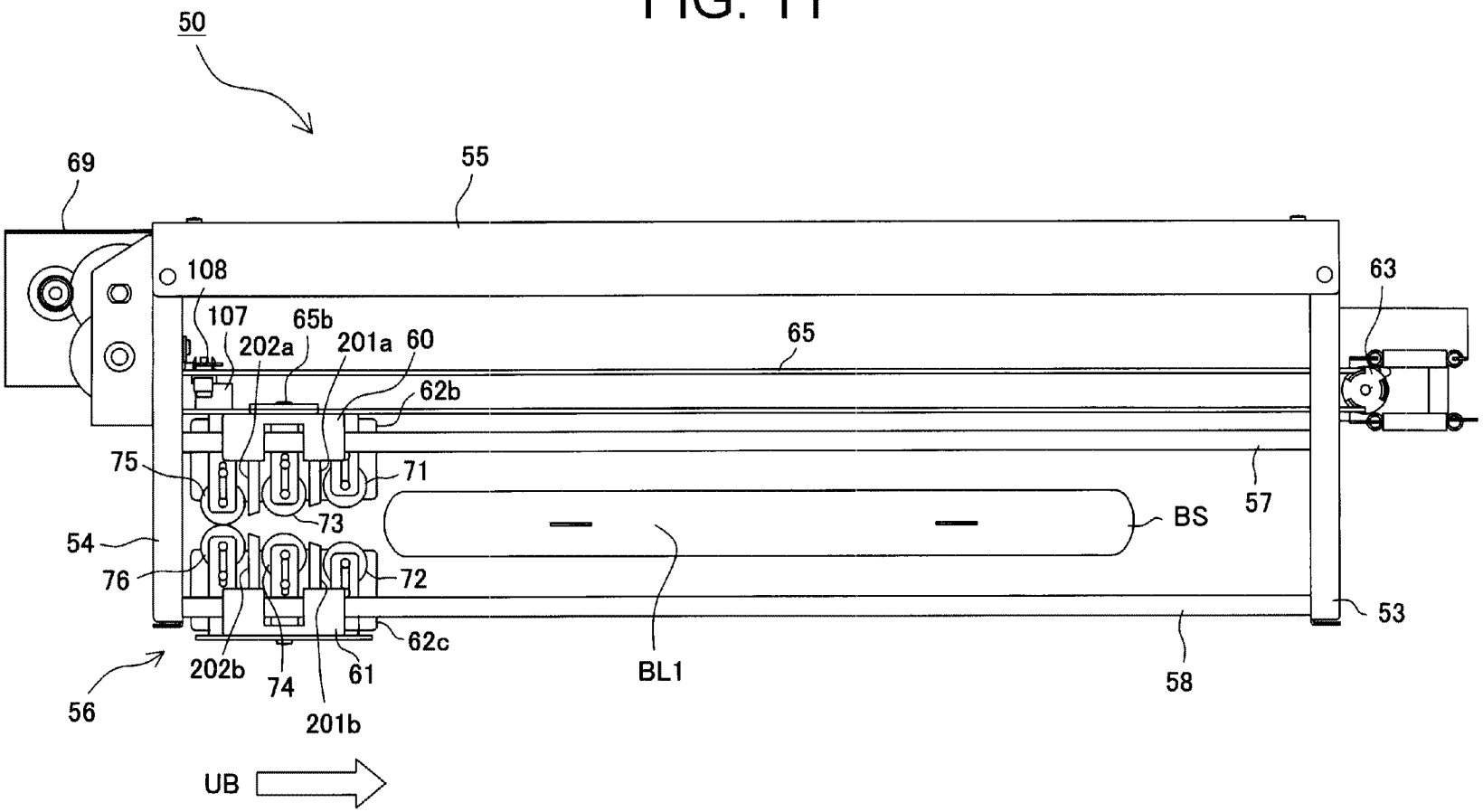
FIG. 11 is a front view illustrating a state where the support unit illustrated in FIGS. 4 to 10A and 10B that supports the pressing roller pairs is situated at an initial position.
Figure 12:
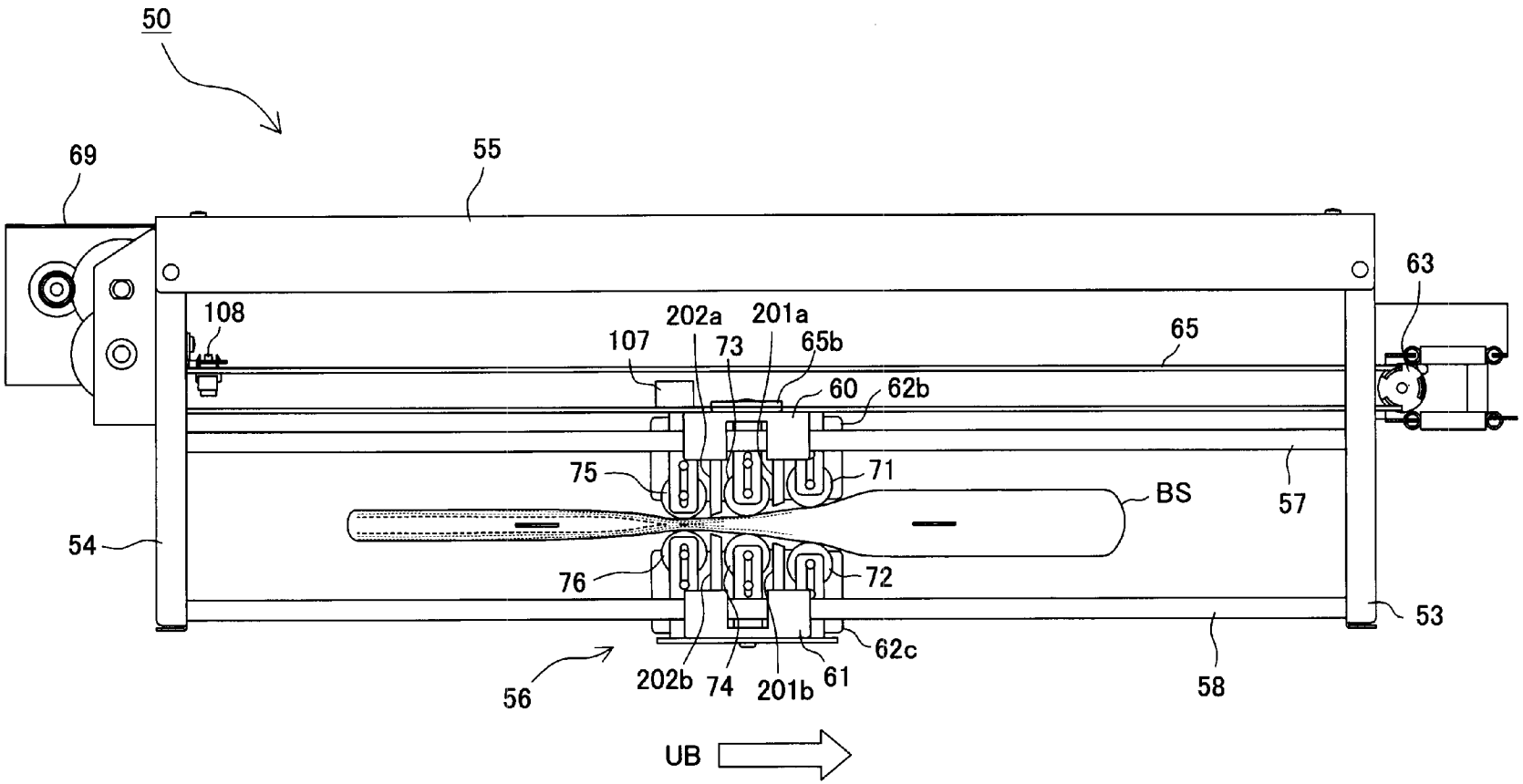
FIG. 12 is a front view illustrating a state where the support unit illustrated in FIGS. 4 to 10A and 10B is being moved in the middle of the folded sheet bundle in a width direction thereof.
Figure 13:
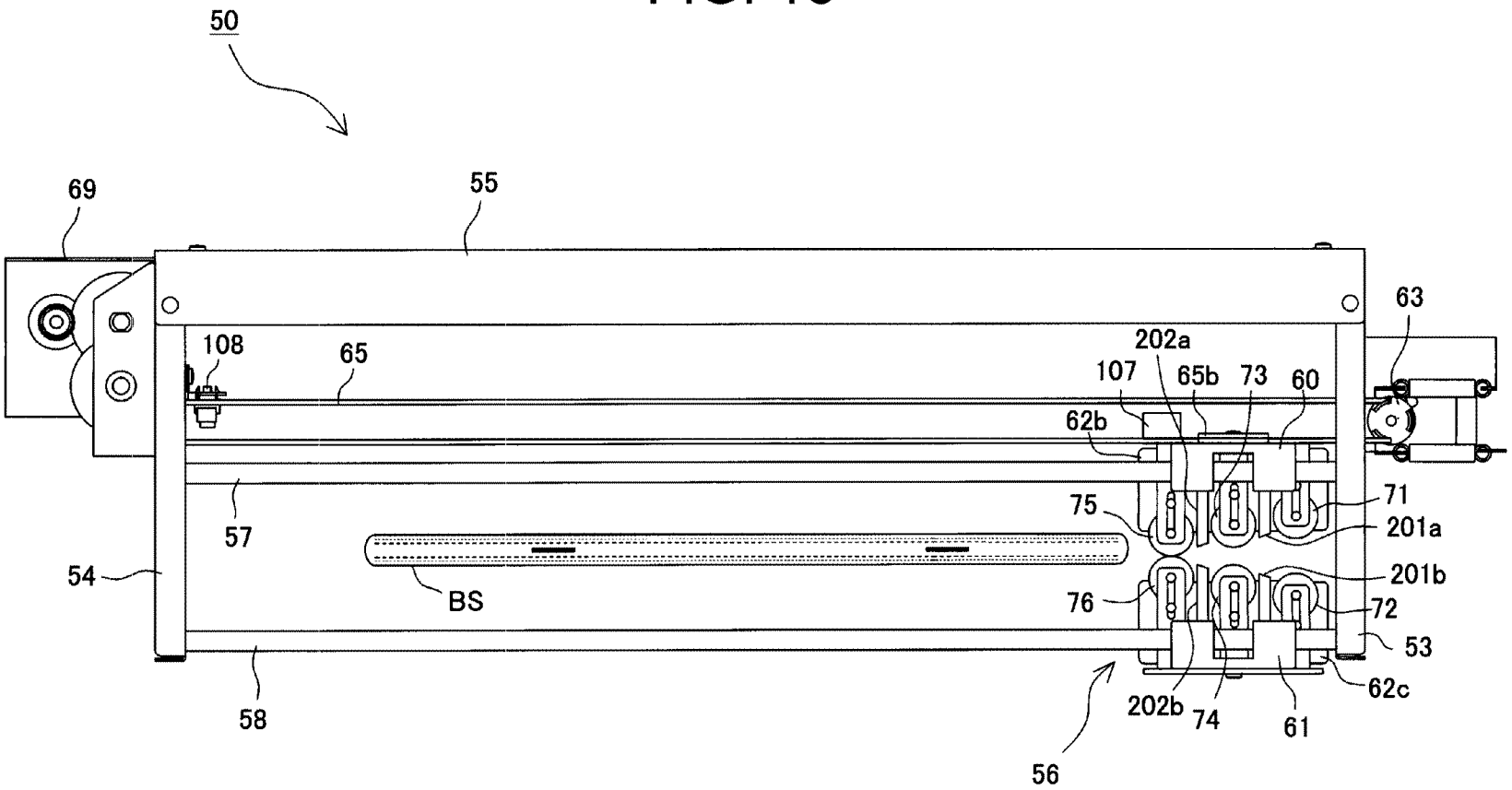
FIG. 13 is a front view illustrating a state where the support unit illustrated in FIGS. 4 to 10A and 10B is situated at an end position in the width direction.

Hereinafter, carry-in of the folded sheet bundle BS to the support unit 56 of the stepwise folding unit 50 and stepwise pressing operation of the support unit 56 will be described with reference to FIGS. 11 to 13. FIGS. 11 to 13 illustrate the support unit 56 as viewed from the bundle discharge side, in which the unit base plate 62*a* of the support unit 56 is omitted for descriptive convenience. FIG. 11 illustrates a state where the support unit 56 is situated at the home position and waits for carry-in of the folded sheet bundle BS. FIG. 12 illustrates a state where the support unit 56 is situated at a substantial center of the folded sheet bundle BS in a width direction thereof and performs the stepwise folding using three rows of the roller pairs. FIG. 13 illustrates a state where the support unit 56 is situated at the returning position after completion of the stepwise folding using the three rows of the roller pairs. Hereinafter, descriptions will be given of the above respective steps.

In FIG. 11, the unit flag 107 of the support unit 56 having the three rows of the pressing roller pairs 70 is detected by the home position sensor 108 attached to the right side plate 53, that is, it is determined that the support unit 56 is situated at the home position. When a "stepwise folding mode" to be described later is set at this time, the support unit 56 waits for carry-in of the folded sheet bundle BS that is subjected to the folding by the folding roller 45 and conveyed along the folded sheet conveying path BP.

In the support unit 56 situated at the home position, the interval between the pressing roller pairs 70 is reduced from the first row in the moving direction toward the last row. That is, the pressing roller pair 70 of the last row are brought into pressure contact with each other. As described above, in the present embodiment, the first upper and lower pressing rollers 71 and 72 of the first row are disposed at an interval of about 14 mm, the second upper and lower pressing rollers 73 and 74 of the second row are disposed at an interval of about 7 mm, and the third upper and lower pressing rollers 75 and 76 of the third row are brought into pressure contact with each other in a region R1. A center of the separation and pressure contact between the pressing roller pair is set so as to coincide with the folding loop leading end (fold) BL1 which is a center of the folded sheet bundle BS.

When the folding loop of the folded sheet bundle BS becomes a predetermined size (for example, in the present embodiment, 22 mm in the vertical direction of the loop), the folding roller 45 is stopped, and the unit drive motor is driven to move the support unit 56 to the right in FIG. 11. When this movement is started, the first upper and lower pressing rollers 71 and 72 of the first row override a left side (one end side) end portion (sheet end portion) of the folded sheet bundle BS and are moved to the right while creating a fold at a position slightly above the folding loop leading end BL1. As described above, the size of the loop in the present embodiment is about 22 mm, and the interval between the first upper and lower pressing rollers 71 and 72 is about 14 mm, so that the first upper and lower pressing rollers 71 and 72 overlap the upper and lower portions of the loop, respectively, each by a length of slightly less than about 4 mm to thereby creating a first fold line 100 illustrated in FIG. 14A.

Further, since the first upper and lower pressing rollers 71 and 72 are disposed at a large interval, the pressing rollers 71 and 72 can override the end portion of the folded sheet bundle BS without significantly damaging the end portion. Further, the pressing rollers 70 including the first upper and lower pressing rollers 71 and 72 are axially rotatably supported in the same direction as the sheet conveying direction and each rotatably supported on this axis. This rotation also makes it easy for the pressing rollers to ride over the end portion of the folded sheet bundle.

Further, the first and second upper guide plates 201*a* and 202*a* are disposed between the first and second upper pressing rollers 71 and 73 and the second and third upper pressing rollers 73 and 75, respectively. Further, on a opposite side of the upper guide rollers with respect to the folding loop BL, the first and second lower guide plates 201*b* and 202*b* are disposed between the first and second lower pressing rollers 72 and 74 and the second and third lower pressing rollers 74 and 76, respectively. With this configuration, the folding loop BL of the folding sheet bundle BS is smoothly guided between the upstream side pressing roller pair 70 without being rolled up between the pressing rollers of adjacent rows.

When the support unit 56 is further moved, the loop of the folded sheet bundle BS pressed between the first upper and lower pressing rollers 71 and 72 is further pressed between the second upper and lower pressing rollers 73 and 74, the interval between which is slightly smaller than the interval between the first upper and lower pressing rollers 71 and 72, whereby a second fold is created. In the present embodiment, the interval between the second upper and lower pressing rollers 73 and 74 is set to about 7 mm, so that the second upper and lower pressing rollers 73 and 74 overlap the respective upper and lower portions of the loop which has been pressed by the first upper and lower pressing rollers 71 and 72, each by a length of about 3.5 mm to thereby creating a second fold line 101 illustrated in FIG. 14B.

Successively, the folding loop BL1 is subjected to the stepwise folding between the third upper and lower pressing rollers 75 and 76 of the third row. That is, the third upper and lower pressing rollers 75 and 76 are brought into a substantially pressure contact state with the interval therebetween set to 0, so that they press the fold while being pressed by the third upper and lower pressing roller pressing springs 149*a* and 149*b* by an amount corresponding to a thickness of the sheet bundle at the fold to thereby creating a final fold line 102 illustrated in FIG. 14C.

FIG. 12 illustrates a state where the support unit 56 pressing the folded sheet bundle BS in a stepwise manner is situated at a substantial center of the folded sheet bundle BS in the sheet width direction thereof. From this state, the support unit 56 is further moved to the right in FIG. 12 while adding a fold to the sheet bundle in a stepwise manner by the pressing roller pairs the interval between which in the sheet thickness direction is reduced. With this movement, the third upper and lower pressing rollers 75 and 76 of the third row pass through and apply the stepwise folding to the right side (one end side) end portion (sheet end portion) of the folded sheet bundle BS.

After passing through the folded sheet bundle BS, the support unit 56 reaches the returning position at the right side plate 53 side. This state is illustrated in FIG. 13. When the support unit 56 reaches the returning position, drive of the unit drive motor 69 is stopped. Thereafter, the support unit 56 waits for the pressed folded sheet bundle BS (folded sheet bundle BS that has been subjected to the pressing by the pressing rollers 70) to be discharged by rotation of the folding roller 45 and the bundle discharge roller 49 in the discharge direction. When a state where the stepwise-folded sheet bundle BS is discharged is detected by the bundle discharge sensor (SEN4) 131, the support unit 56 is returned from the returning position to the home position and waits for carry-in of the next folded sheet bundle BS at the position (home position) illustrated in FIG. 11.

In the above description, the support unit 56 is returned to the home position after the stepwise-folded sheet bundle BS of FIG. 13 is discharged; alternatively, however, the following configuration may be adopted. That is, before discharge of the folded sheet bundle BS, the support unit 56 is moved from the right to left of FIG. 13 toward the home position to press once again the fold of the folded sheet bundle BS by the third upper and lower pressing rollers 75 and 76, whereby the stepwise folding by the pressing rollers of the last row can surely be performed.

As described above, in the present embodiment, the support unit 56 is used to perform the three-step folding for the folded sheet bundle BS. The following describes the folded sheet bundle BS in a state after being stepwise-folded and discharged with reference to FIGS. 14A to 14D.

Figure 14A:
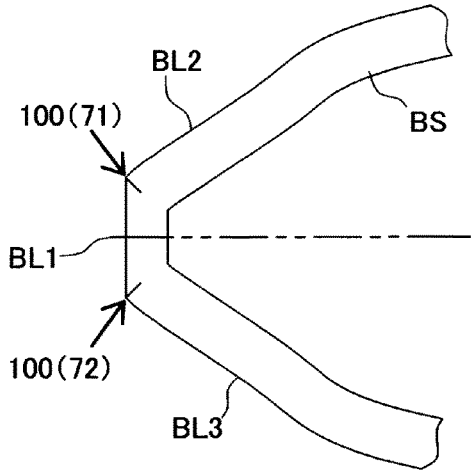
Figure 14B:
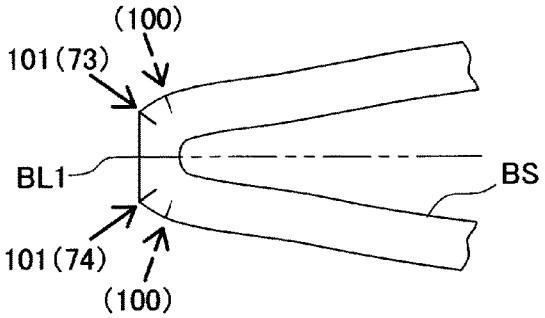
Figure 14C:
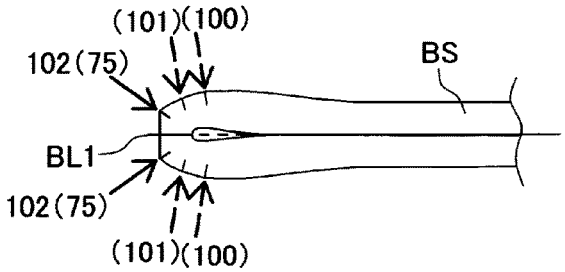
Figure 14D:
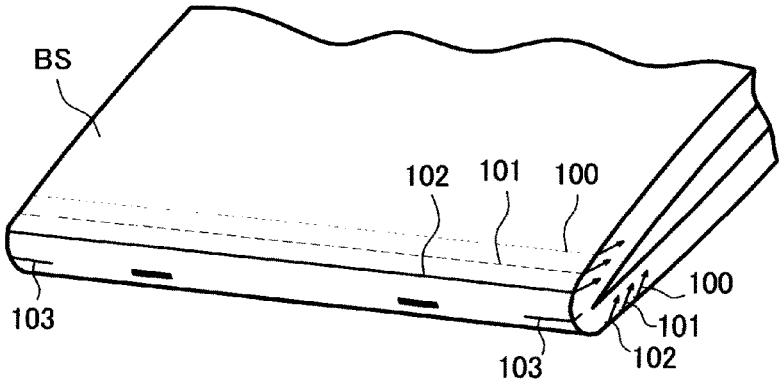

As described hereinbefore, the first upper and lower pressing rollers 71 and 72 as the sheet bundle pressing member of the present invention are moved, along the fold direction, on a part of the folded sheet bundle BS where the fold is created by the folding roller 45 and thus the loop is generated while pressing the folded sheet bundle BS in a thickness direction (vertical direction crossing, at the fold of the folded sheet bundle BS, a conveying direction of the folded sheet bundle BS) of the fold to thereby create a plurality of folds. As described above, the interval between the first upper and lower pressing rollers 71 and 72 of the first step is set to a value (in the present embodiment, about 14 mm relative to the loop size (height) of 22 mm) slightly smaller than the loop size, and the first upper and lower pressing rollers 71 and 72 are moved along the fold created by the folding roller 45 to thereby create the first fold. The first fold is illustrated as a first fold line 100 indicated by a solid arrow in FIG. 14A. In FIG. 14D, this first fold line 100 is represented by a light line on the folded sheet bundle BS. That is, as illustrated in FIG. 14A, a part of the loop that is pressed by the first upper and lower pressing rollers 71 and 72 is applied with a concentrated load, causing buckling in the sheet bundle to generate the fold. Then, by the movement of the first upper and lower pressing rollers 71 and 72 in the width direction, the buckled part appears as the first fold line 100.

In the second step, the second upper and lower pressing rollers 73 and 74 as the sheet bundle pressing member, the interval between which is set to a value (in the present embodiments, about 7 mm) slightly smaller than the size of the loop pressed in the first step, and the second upper and lower pressing rollers 73 and 74 are moved along the fold created by the folding roller 45 to thereby create the second fold. The second fold is illustrated as a second fold line 101 positioned on a back side of the first fold line 100 and indicated by a solid arrow in FIG. 14B. In FIG. 14D, this second fold line 101 is represented by a dashed line on the folded sheet bundle BS. That is, as illustrated in FIG. 14B, a part of the loop that is pressed by the second upper and lower pressing rollers 73 and 74 is applied with a concentrated load, causing buckling in the sheet bundle to generate the fold. Then, by the movement of the second upper and lower pressing rollers 73 and 74 in the width direction, the buckled part appears as the second fold line 101.

The third upper and lower pressing rollers 75 and 76 as the sheet bundle pressing member of the final step are brought into pressure contact with each other by the elastic force of the third upper and lower pressing roller pressing springs 149*a* and 149*b*. In the final step, unlike the first and second steps, no interval is provided between the third upper and lower pressing rollers 75 and 76 (in the present embodiment, interval is set to 0).

Thus, in the final step, the third upper and lower pressing rollers 75 and 76 are moved along the fold while pressing the position corresponding to the thickness of the folded sheet bundle BS that has been pressed in the first and second steps. The fold created by the pressing rollers of the final step is illustrated as a final fold line 102 indicated by a solid arrow in FIG. 14C. In FIG. 14D, this final fold line 102 is represented by a comparatively dark line on the folded sheet bundle BS.

At end portions of the folded sheet bundle BS in the width direction, end portion folds 103 created when the folding roller 45 and the pressing rollers 70, which are brought into a pressure contact state, override the folded sheet bundle BS are formed. A part that is pressed between the third upper and lower pressing rollers 75 and 76, which are brought into a substantially pressure contact state, appears as an enhanced fold, i.e., the final fold line 102.

As described above, the pressing roller pairs 70 having different intervals are used to buckle the folded sheet bundle BS to create the folds. As a result, a folding direction is directed to a closing direction (line extending in the conveying direction that passes the fold) of the folded sheet bundle BS at the respective positions of the first fold line 100 (indicated by the light line) of the first step, the second fold line 101 (indicated by the dashed line) of the second step, and the final fold line 102 (indicated by the comparatively dark line) of the final step generated in accordance with the thickness of the folded sheet bundle BS. With this configuration, it is possible to prevent the folded sheet bundle BS from being opened to thereby prevent degradation of aligning property and accumulating property.

[Control Configuration]

Figure 15:
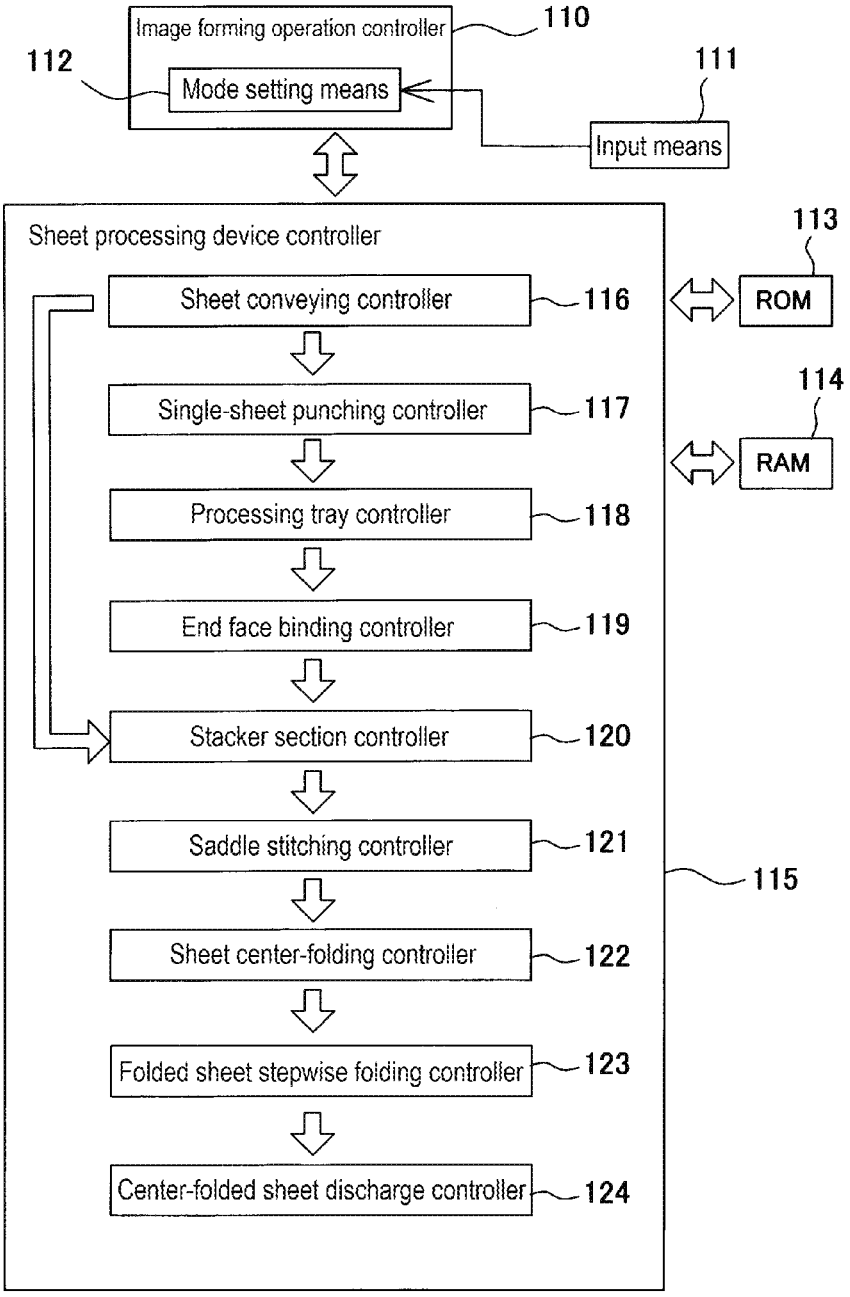
FIG. 15 is an explanatory view of a control configuration of the sheet processing device of FIG. 2.

Control configurations of the sheet processing device B provided with the thus described stepwise folding unit 50 and the image forming device A including the sheet processing device B will be described based on a block diagram of FIG. 15. An image forming device controller 110 having an image forming means inputs desired processing through user's operation made to an input means 111 provided on a control panel 18. This input controls a sheet processing device controller 115 of the sheet processing device B based on a mode setting means.

Processing modes of the sheet processing device B of the present embodiment are as follows.

That is, the modes include: (1) "print-out mode" in which the image-formed sheet is housed in a first sheet discharge tray 21; (2) "staple-binding mode" in which the sheets from the main body sheet discharge port 3 are aligned in a bundle, bound by an end face stapler 33, and housed in the first sheet discharge tray 21; (3) "saddle stitching and folding mode" in which the sheets from the main body sheet discharge port 3 are aligned in a bundle in a stacker section 35 which is a second processing tray, bound at a portion near a center thereof using a saddle stitching stapler 40, folded into a booklet, and stored in a second sheet discharge tray 22; and (4) "stepwise folding mode" in which a loop of the sheet bundle that has been saddle-stitched and folded into a booklet is stepwise-folded and then stored in the second sheet discharge tray 22. These processing modes can be selected.

The sheet processing device B includes the sheet processing device controller 115 that is made operable in one of the above four modes, a ROM 113 that stores an operation program, and a RAM 114 that stores control data. The sheet processing device controller 115 includes a sheet conveying controller 116 that controls sheet conveyance in the device, a single-sheet punching controller 117 that applies punching, one by one, the sheets by means of a single-sheet punching unit 28, a processing tray controller 118 that performs control of accumulating the sheets on the processing tray 29, and an end face binding controller 119 that binds the end face side of the sheets accumulated in a bundle in the processing tray 29 and discharges the bound sheet bundle after the binding.

The saddle stitching or center-folding of the sheet bundle at about a half position thereof in the sheet conveying direction is controlled by a stacker section controller 120 that accumulates the sheet bundle in the sheet stacker section 35. The stacker section controller 120 uses the stopper 38 or aligning member 39 that regulates the leading end of the sheets carried in, one by one, to the stacker section 35 to generate an aligned sheet bundle. The sheet processing device controller 115 further includes a saddle stitching controller 121 that controls the saddle stitching stapler 40 to drive a staple or the like to a center portion of the sheet bundle and a sheet center-folding controller 122 that controls the folding blade 46 to push the saddle-stitched sheet bundle into the folding roller 45 to center-fold the sheet bundle. The sheet center-folding controller 122 is connected to the sheet bundle detection sensor (SEN3) 129 and a not illustrated encoder sensor and controls a motor that drives the folding roller 45 based on an output signal from the sensors.

The sheet processing device controller 115 further includes a folded sheet stepwise folding controller 123 that is connected to the unit drive motor 69 that moves the support unit 56 supporting a plurality of rows of the pressing roller pairs 70 and controls the unit drive motor 69 according to the above-described "stepwise folding mode". The folded sheet stepwise folding controller 123 is connected also to the home position sensor 108 that is used to check whether or not the support unit 56 of the stepwise folding unit is situated at the home position.

The folded sheet bundle BS that has been stepwise-folded is discharged and accumulated in the second sheet discharge tray 22 under control of a center-folded sheet discharge controller 124 connected to a bundle discharge roller drive motor that drives the bundle discharge roller 49. The center-folded sheet discharge controller 124 is connected to the bundle discharge sensor (SEN4) 131 and controls discharge operation of the folded sheet bundle BS.

The folded sheet stepwise folding control related especially to the present invention has been described based on the description of the respective mechanisms and using operation state explanatory views of FIGS. 11 to 13, so descriptions thereof will be omitted. The stepwise folding unit 50 is controlled so as to execute the sheet pressing based on the contents described.

It should be appreciated that the present invention is not limited to the present embodiment, and various modifications may be made thereto. Further, all technical matters included in the technical ideas set forth in the claims should be covered by the present invention. While the invention has been described based on a preferred embodiment, those skilled in the art can realize various substitutions, corrections, modifications, or improvements may be made from the content disclosed in the specification by a person skilled in the art, which are included in the scope defined by the appended claims.

This application is based upon and claims the benefit of priority from prior Japanese Patent Applications No. 2015-045713, No. 2015-045714, and No. 2015-045715, which are filed Mar. 9, 2015, the entire contents of which are incorporated herein by reference.

What is claimed is:

1. A sheet processing device comprising:

a plurality of first units that press a folding loop of a folded sheet bundle; and a second unit that is moved along the folding loop while supporting the first units, wherein the first units each include, as one unit, a pressing member that presses the folding loop, a frame that movably holds the pressing member in a sheet pressing direction, and an elastic member that is disposed between the frame and the pressing member so as to bias the pressing member in the sheet pressing direction, and the second unit supports, as one unit, a plurality of rows of the first units such that the first units of each row are arranged, as a pair, so as to be opposed to each other and that an interval between the pair is reduced stepwise from a downstream side to an upstream side in a moving direction of the second unit.

2. The sheet processing device according to claim 1, wherein the pressing member of the first unit has a roller that presses the folding loop while rotating.

3. The sheet processing device according to claim 2, wherein the first unit further slidably supports, along an inner wall of the frame, a roller bracket that supports the pressing roller and serves as a receiving member for the elastic member disposed between the roller bracket and the frame and has, on an outer wall of the frame, a support arm whose one end is fixed to the frame and the other end movably supports the roller bracket.

4. A sheet processing device comprising:

a plurality of pressing roller units that press a folding loop of a folded sheet bundle; and a support unit that is moved along the folding loop while supporting the pressing roller units, wherein the pressing roller units each include, as one unit, a rotatable pressing roller that presses the folding loop, a frame that movably holds a roller bracket that holds the pressing roller, and an elastic spring that is disposed between the frame and the roller bracket so as to bias the pressing roller in a sheet pressing direction, and the support unit supports, as one unit, a plurality of rows of the pressing roller units such that each pressing roller unit is arranged in a pair opposed to each other and that an interval between the pair is reduced stepwise from a downstream side to an upstream side in a moving direction of the support unit and includes an adjustment member for adjusting a position of the pressing roller units.

5. A sheet processing device comprising:

a plurality of rows of pressing rollers that press a folding loop of a folded sheet bundle in a thickness direction; and a support unit that moves the plurality of rows of pressing rollers along the folding loop with the pressing rollers of each row opposed to each other and supports the plurality of rows of pressing rollers such that an interval between the opposed pressing rollers is reduced stepwise from a downstream side to an upstream side in a moving direction of the support unit, wherein the support unit includes, between the pressing rollers of adjacent rows in the moving direction, a guide member that guides the folding loop.

6. The sheet processing device according to claim 5, wherein there are a plurality of rows of the guide members, the guide members are each constituted of a guide plate having a guide portion, the guide portions are disposed as a pair between the pressing rollers of the adjacent rows so as to extend in the moving direction and to expose peripheral surfaces of the pressing rollers therebefore and thereafter, and the folding loop is guided to a funnel cross-sectional-shaped space formed by the pressing rollers and the guide portions.

7. The sheet processing device according to claim 6, wherein the guide plate is positioned between the adjacent pressing rollers in the moving direction by the pressing roller disposed upstream or downstream thereof in the moving direction.

8. The sheet processing device according to claim 7, wherein the guide portions are disposed opposite to each other, an interval between the guide portions is reduced from the downstream side to upstream side in the moving direction, and the guide portions each have a guide slope inclined corresponding to the positions of the pressing rollers therebefore and thereafter.

9. The sheet processing device according to claim 8, wherein the pressing roller and the guide slope positioned upstream of the pressing roller in the moving direction of the support unit are disposed such that a tangent line forming an approximate right angle to a straight line passing through a center axis of the pressing roller in a direction substantially perpendicular to the moving direction of the support unit crosses the guide slope.

10. The sheet processing device according to claim 8, wherein the guide slope and the pressing roller positioned upstream of the guide slope in the moving direction of the support unit are disposed such that a guide upstream portion of the guide slope falls within a range of a peripheral surface of the pressing roller on the side of the guide portion that is surrounded by a straight line passing through a center axis of the pressing roller and extending along the moving direction of the support unit and a perpendicular line forming an approximate right angle to the straight line.

11. The sheet processing device according to claim 8, wherein the guide slope and the pressing roller positioned downstream of the guide slope are disposed such that a tangent line forming an approximate right angle, at a peripheral surface of the downstream side pressing roller, to a perpendicular line passing through a center axis of the downstream side pressing roller in a direction substantially perpendicular to the moving direction of the support unit crosses the guide slope, and the guide slope and the pressing roller positioned upstream of the guide slope are disposed such that a guide upstream portion of the guide slope falls within a range of a peripheral surface of the upstream side pressing roller on a side of the guide slope that is surrounded by a straight line passing through a center axis of the upstream side pressing roller and extending along the moving direction of the support unit and a perpendicular line forming an approximate right angle to the straight line.

12. A sheet processing device comprising:

a plurality of rows of pressing members that press a folding loop of a folded sheet bundle in a thickness direction; and a support unit that is moved along the folding loop with the pressing members of each row opposed to each other and supports the plurality of rows of the pressing members such that an interval between the opposed pressing members is reduced stepwise from a downstream side to an upstream side in a moving direction of the support unit; and a guide plate disposed between the pressing members of adjacent rows in the moving direction of the support unit so as to guide the folding loop, wherein the guide plate is positioned by the pressing member therebefore or thereafter.

13. The sheet processing device according to claim 12, wherein the guide plate is positioned and supported by the pressing member positioned upstream thereof in the moving direction of the support unit.

14. The sheet processing device according to claim 12, wherein the guide plate is positioned and supported by the pressing member positioned downstream thereof in the moving direction of the support unit.

15. The sheet processing device according to claim 13, wherein the pressing member includes a rotatable pressing roller that presses the folding loop and a pressing roller frame mounted to the support unit that supports the pressing roller, and the guide plate includes a guide slope that guides the folding loop between the pressing rollers therebefore and thereafter and a mounting portion mounted to the upstream side pressing roller frame.

16. The sheet processing device according to claim 15, the mounting portion of the guide plate to the pressing roller frame is a projection portion to be fitted to a cut portion or a concave portion formed in the upstream side pressing roller frame.

17. The sheet processing device according to claim 16, wherein the guide slope of the guide plate extends longer to the pressing rollers therebefore and thereafter in the moving direction than the mounting portion.

18. The sheet processing device according to claim 17, wherein there are a plurality of rows of the guide plates, the guide plates each have the guide slope, the guide slopes are disposed as a pair between the pressing rollers of the adjacent rows so as to extend in a direction crossing the moving direction and to expose peripheral surfaces of the pressing rollers therebefore and thereafter, and the folding loop is guided to and pressed in a substantially funnel cross-sectional-shaped space formed by the pressing rollers and the guide slopes.

19. The sheet processing device according to claim 18, wherein the guide slope and the pressing roller positioned downstream of the guide slope are disposed such that a tangent line forming an approximate right angle, at a peripheral surface of the downstream side pressing roller, to a perpendicular line passing through a center axis of the downstream side pressing roller in a direction substantially perpendicular to the moving direction of the support unit crosses the guide slope, and the guide slope and the pressing roller positioned upstream of the guide slope are disposed such that a guide upstream portion of the guide slope falls within a range of a peripheral surface of the upstream side pressing roller on a side of the guide slope that is surrounded by a straight line passing through a center axis of the upstream side pressing roller and extending along the moving direction of the support unit and a perpendicular line forming an approximate right angle to the straight line.

20. An image forming device comprising:

an image forming section that forms an image onto a sheet; and a sheet processing device that applies predetermined sheet processing to the sheet from the image forming section, wherein the sheet processing device is the sheet processing device as claimed in claim 1.

* * * * *